US005775119A

United States Patent [19]

Yamada et al.

[11] Patent Number: 5,775,119

[45] Date of Patent: Jul. 7, 1998

[54] AIR CONDITIONER OUTDOOR UNIT HOUSING

[75] Inventors: Wazo Yamada, Ora-machi; Hideo Maeda, Ashikaga; Yoshinori Yoshida, Oizumi-machi; Yoshimi Okamoto, Ota; Koichiro Seki, Oizumi-machi; Keiko Ohno, Ashikaga; Masato Inuzuka; Hideyuki Takayama, both of Oizumi-machi, all of Japan

[73] Assignee: Sanyo Electric Co., Ltd., Osaka, Japan

[21] Appl. No.: 562,211

[22] Filed: Nov. 28, 1995

[30] Foreign Application Priority Data

| | | | |
|---|---|---|---|
| Feb. 21, 1995 | [JP] | Japan | 7-052088 |
| Feb. 21, 1995 | [JP] | Japan | 7-055237 |
| Mar. 17, 1995 | [JP] | Japan | 7-084468 |
| Apr. 7, 1995 | [JP] | Japan | 7-107132 |

[51] Int. Cl.[6] ..... F25D 23/12

[52] U.S. Cl. ..... 62/259.1; 62/508; 312/100; 312/229; 312/236

[58] Field of Search ..... 62/259.1, 428, 62/508, 262, 263; 312/100, 229, 236

[56] References Cited

U.S. PATENT DOCUMENTS 4,736,598 4/1988 Sameshima et al. ..... 62/259.1

FOREIGN PATENT DOCUMENTS 0 424 614 A1 5/1991 European Pat. Off. .

1 273 323 5/1972 United Kingdom .

*Primary Examiner*—John M. Sollecito

*Attorney, Agent, or Firm*—Armstrong, Westerman, Hattori, McLeland & Naughton

[57] ABSTRACT

An outdoor unit for use in a separate type air conditioner which includes an outdoor unit and an indoor unit each having at least a compressor, a heat exchanger, and a expansion device, with one unit connected with the other by refrigerant-tubes so that they altogether form an air conditioning system. The outdoor unit comprises: a baseplate, a housing having a first air intake window (side air intake window) in one of its side walls, a second air intake window (rear air intake window) formed in the rear wall extending upright from the baseplate, and an air outlet window (front air outlet window) formed in the front wall; a partition board extending upright from the baseplate and portioning for the internal space of the housing into a fan compartment for accommodating the heat exchanger and a fan for supplying air to the heat exchanger; and a machinery compartment for accommodating the compressor. The outdoor unit is characterized in that: the heat exchanger mounted upright on the baseplate extends over the rear air intake window; the partition board is provided in front of the heat exchanger; the partition board is disposed in front of the heat exchanger by securing a peripheral frame of the partition board on the front end of a peripheral frame of the heat exchanger by screws applied from the rear of the heat exchanger.

4 Claims, 20 Drawing Sheets

AIR CONDITIONER OUTDOOR UNIT HOUSING

FIELD OF THE INVENTION

This invention relates to a separate type air conditioner having an indoor and an outdoor units, and more particularly to an improvement in an outdoor unit for such air conditioner.

BACKGROUND OF THE INVENTION

An outdoor unit for use with a separate type air-conditioner generally has air intake windows in the rear wall and the side wall of a housing of the unit (which windows are hereinafter referred to as rear air intake window and side air intake window, respectively), and an air outlet window in the front wall of the housing. A heat exchanger and a fan is installed in a fan compartment in the housing. The heat exchanger has two sections which extend along two adjacent walls of the housing. A compressor is installed in a machinery compartment in the housing. These rooms are separated from each other by means of a partition board. An indoor unit also includes a heat exchanger and a fan for forced circulation of the air, warmed or cooled by the heat exchanger, through a space to be air conditioned. The indoor and outdoor units are fluid mechanically interconnected with each other via tubes for exchanging refrigerant. The two units are also connected electrically with each other. For example, the outdoor unit is implemented with an electric power cord for supplying electric power and additional cords for supplying control signals so that the outdoor unit may operate in an optimum mode for the air conditioner. These signals include such control parameters as temperature and humidity of the air conditioning space.

The partition board separating the fan compartment from the machinery compartment in the outdoor unit is usually secured to the baseplate of the housing and to one end of the heat exchanger by screws.

The heat exchanger in the outdoor unit must be often dismounted from the housing for the purpose of repairing the unit or cleaning out the heat radiator to remove dust accumulated in the radiator. In such cases the partition board must be removed from the heat exchanger prior to dismounting the heat exchanger from the baseplate. In order to do so, however, the screws fastening the partition board to the heat exchanger must be removed from the rear, i.e. from the side of the partition board facing the machinery compartment, since the heat exchanger, partition board, and the compressor are normally installed in the housing in this order from the back of the housing. Furthermore, since these screws are located behind the compressor to allow the heat exchanger to extend in the fan compartment behind the compressor, it is difficult to dismount the partition board without dismounting the compressor. Thus, maintenance of the heat exchanger is a very tedious work in that, in addition to connecting and disconnecting refrigerant tubes, it requires dismounting and re-mounting the compressor and the partition board along with the heat exchanger.

Another disadvantage pertinent to conventional outdoor units is that the housing has a flat ceiling, which is not desirable because rain drops falling on the ceiling run down from the ceiling to the side walls and the front wall, and easily flow into the housing through the side air intake window and the front air outlet window. If this happens in cold weather when the air conditioner is used as a heating system, rain water will eventually freeze on the fan while the fan is stopped temporally for intermittent OFF periods, since then the fan is significantly cooled by the heat exchanger serving as an evaporator in the outdoor unit. Such freezing of rain water will deprive the outdoor unit of its normal mechanical ability. Therefore, it is desirable to provide an improved design of the housing capable of better accomodating rain water.

It is also important for an outdoor unit that its housing should be rigid enough to bear a fairly large weight, because the outdoor unit is often used to place some objects, like flower pots, after the unit is installed and a person might step on the housing. However, the rigidity of the ceiling should be provided without the use of thick steel plates, since thick steel plates are heavy and costly. Therefore it is preferable to provide means for providing sufficient rigidity to the housing using light material.

The heat exchanger in the outdoor unit is usually constructed in an L-shape as viewed from the top thereof so that the heat exchanger may intake air not only from the rear air intake window but also from the side air intake window, and discharge the air out of the air outlet window in the front wall of the housing. In an attempt to provide sufficient air to the heat exchanger, the side air intake window of a conventional outdoor unit consists of two columns of horizontal slits having the same width.

However, if the side air intake windows have such configurations as described above, a strip or an intermediate section separating the two columns is located at the center of the side air intake window, thereby blocking a main stream of air through the window, creating a large air resistance. The blocked air stream would otherwise contribute to heat exchange in the heat exchanger directly behind the strip. Thus, this type of side air intake windows is not desirable from the point of thermal efficiency of the unit.

It is also important that the various elements of the outdoor unit are arranged so that the entire unit has a generally "thin" configuration, since a thin unit may be installed neatly and has a better look. In the design of an outdoor unit, a side air intake window having two identical columns of slits as described above, is disadvantageous, since they are not only of an inefficient configuration, as pointed out above, but also this is a configuration that gives an impression that the unit is large in width.

Conventional air outlet windows are often provided with protective guards having a multiplicity of horizontally elongate rectangular openings. These openings are usually designed to diffuse the air out of the window sideways, so that the air will not be blown forward, i.e. in a direction normal to the window. However, this type of the air outlet window is not desirable when the air should not be blown out of the window sideways because, for example, there are some flowers planted downstream of the air blown sideways.

The invention is directed to overcome these disadvantages pertinent to the conventional outdoor units. Therefore, it is an object of the present invention to provide an improved structure of an outdoor unit for a separate type air conditioner which is easy to install and convenient for maintenance.

It is another object of the invention to provide an outdoor unit whose the heat exchanger may be easily mounted and dismounted from the other elements of the unit.

It is another object of the invention to provide an outdoor unit having a rugged and, yet, low cost housing.

It is a further object of the invention to provide an outdoor unit having a housing capable of reducing inoperability and contamination of the unit caused by rain drops flowing therein.

It is a still further object of the invention to provide an outdoor unit having an improved air intake window which has a maximum flow rate of air for the heat exchanger and gives a thin look to the unit.

It is a still further object of the invention to provide an outdoor unit having an improved air outlet window capable of blowing air in a desired direction.

SUMMARY OF THE INVENTION

In one aspect of the invention, there is provided an outdoor unit for use in a separate type air conditioner which includes an outdoor unit and an indoor unit each having at least a compressor, an heat exchanger having a circumferential frame, and a expansion device, said outdoor and indoor units connected with each other by refrigerant tubes so that they, altogether, form the air conditioner, the outdoor unit comprising: a baseplate; a housing having a side wall in which a first air intake window is formed, a rear wall extending upright from said baseplate and having a second air intake window, and a front wall having an air outlet window; and a partition board having a peripheral frame and extending upright from the baseplate for portioning the internal space of the housing into a fan compartment for accommodating the heat exchanger and a fan for supplying air to the heat exchanger, and a machinery compartment for accommodating the compressor, wherein the heat exchanger extends over the rear air intake window in the rear wall when the heat exchanger is mounted upright on the baseplate; and wherein the partition board is disposed in front of the heat exchanger by securing the circumferential frame of the partition board on a front end of the circumferential frame of the heat exchanger by screws applied from the rear of the heat exchanger.

The heat exchanger may be promptly mounted/dismounted together with the partition board detachably mounted in front of the heat exchanger by the screws, without removing the compressor, as in conventional outdoor units.

The outdoor heat exchanger and the partitioning board each have peripheral frames. It would be preferable to provide the frame of the heat exchanger with non-threaded bores (hereinafter referred to as frame bores) and the frame of the partition board with threaded bores for receiving the screws to secure the partition board on the heat exchanger. In increasing the heat transport area of the heat exchanger, it is preferable to permit the heat exchanger to extend, as much as possible, along the rear wall. That is, the heat exchanger is preferably extended to a region behind the compressor. This implies that the frame bores are disposed in a region of the frames right behind the compressor, as viewed from the front side of the outdoor unit.

The outdoor heat exchanger may be configured in the form of an in the top view, so that it partially faces the side air inlet window and partially faces the rear air inlet window of the housing. In this case, it is preferable to provide the side air inlet window with two vertical columns of horizontal slits having different dimensions (hereinafter referred to as front and rear columns, respectively) and an intermediate strip separating the two columns, and to provide the ceiling of the housing with two plateau regions (front and rear plateau regions) extending from one side to the other of the ceiling and having widths that correspond to respective columns of slits in the side wall. The distance between the two plateau regions i.e. the width of a groove between the plateau regions matches the width of the strip between the columns of the slits. Accordingly, the groove is contiguous to the strip between the columns of the slits.

The plateau regions of the ceiling add strength to the ceiling, and the groove helps raindrops falling on the ceiling to escape smoothly from the ceiling to the ground through the intermediate strip on the side wall. This prevents the rain water from entering the housing through the slits. It should be appreciated that the plateau regions thus decrease the amount of rain water that runs down the front wall and into the outdoor unit. This is desirable to prevent freezing of the rain water in the outdoor unit during winter. Further, the groove between the plateaus may be conveniently used for placing various tools and parts during installation.

It is should be noted that the width of the front column of the slits may be advantageously greater than the width of the rear column. The width of the front plateau on the ceiling, associated with the front column of the slits, is thus larger than the width of the rear plateau.

This combination of a wider front column and a narrower rear column of slits has several advantages over conventional windows. First, the outdoor unit having this design looks thinner and has a neat configuration. Second, the side air intake window provides a more efficient use of slits than the conventional one in that the air intake window does not have an air-blocking strip in the middle of the window where the flow rate of the air is greatest, thereby reducing the effect of the strip in the window. The strip is shifted to a backward position where the flow rate is not very large.

In a further aspect of the invention, there is provided an outdoor unit for use in a separate type air conditioner which includes an outdoor unit and an indoor unit each having at least a compressor, a heat exchanger having a circumferential frame, and a expansion device, said outdoor and indoor units connected with each other by refrigerant tubes so that they altogether form the air conditioner, the outdoor unit comprising: a baseplate; a housing having a side wall in which a first air intake window is formed, a rear wall extending upright from said baseplate and having a second air intake window, and a front wall having an air outlet window; and a partition board having a peripheral frame and extending upright from the baseplate for portioning the internal space of the housing into a fan compartment for accommodating the heat exchanger and a fan for supplying air to the heat exchanger, and a machinery compartment for accommodating the compressor, wherein the heat exchanger extends over the rear air intake window in the rear wall when the heat exchanger is mounted upright on the baseplate; and wherein the partition board is disposed in front of the heat exchanger by securing the peripheral frame of the partition board on a front end of the peripheral frame of the heat exchanger by screws applied from the rear of the heat exchanger; the side air inlet window has front and rear vertical columns of horizontal slits having different dimensions and an intermediate strip separating the two columns; and the housing is provided on the ceiling thereof with front and rear plateau regions extending across the ceiling and having widths that match corresponding columns of slits in the side air intake window and with an intermediate groove between the plateau regions which has the same width of, and is contiguous with, the intermediate strip of the side air intake window.

The plateau regions of the ceiling add strength to the ceiling, and the plane region helps raindrops falling on the ceiling to escape smoothly from the ceiling to the ground through the intermediate strip on the side wall. This prevents the rain water from entering the housing through the slits. It should be appreciated that the plateau regions thus decrease the amount of rain water that runs down the front wall and into the outdoor unit. This is desirable to prevent freezing of the rain water in the outdoor unit during winter. Further, the groove between the plateaus may be conveniently used for placing various tools and parts during installation.

In this case, it is advantageous to choose the width of the front column of the slits greater than the width of the rear column. The width of the front plateau region associated with the front column of the slits in the side wall is thus larger than the rear plateau region.

This combination of wider front column and narrower rear column of slits has several advantages over conventional windows. First, the outdoor unit having this design looks thinner and has a neat configuration. Second, the side air intake window provide a more efficient slits than the conventional one in that the air intake window does not have an air-blocking strip in the middle of the window where the flow rate of the air is greatest, thereby reducing the effect of the strip in the window. The strip is shifted to a backward position where the flow rate is not very large.

In a further aspect of the invention, there is provided an outdoor unit for use in a separate type air conditioner which includes an outdoor unit and an indoor unit each having at least a compressor, a heat exchanger having a circumferential frame, and a expansion device, said outdoor and indoor units connected with each other by refrigerant tubes so that they altogether form the air conditioner, the outdoor unit comprising: a baseplate; a housing having a side wall in which a first air intake window is formed, a rear wall extending upright from said baseplate and having a second air intake window, and a front wall having an air outlet window; and a partition board having a peripheral frame and extending upright from the baseplate for portioning the internal space of the housing into a fan compartment for accommodating the heat exchanger and a fan for supplying air to the heat exchanger, and a machinery compartment for accommodating the compressor, wherein the heat exchanger extends over the rear air intake window in the rear wall when the heat exchanger is mounted upright on the baseplate; and wherein the partition board is disposed in front of the heat exchanger by securing the peripheral frame of the partition board on a front end of the peripheral frame of the heat exchanger by screws applied from the rear of the heat exchanger; the side air inlet window has front and rear vertical columns of horizontal slits having different dimensions and an intermediate strip separating the two columns; and the housing is provided on the ceiling thereof with front and rear plateau regions extending across the ceiling and having widths that match corresponding columns of slits in the side air intake window and with an intermediate groove between the plateau regions which has the same width of, and is contiguous with, the intermediate strip of the side air intake window.

The plateau regions of the ceiling add strength to the ceiling, and the plane region helps raindrops falling on the ceiling to escape smoothly from the ceiling to the ground through the intermediate strip on the side wall. This prevents the rain water from entering the housing through the slits. It should be appreciated that the plateau regions thus decreases the amount of rain water that runs down the front wall and into the outdoor unit. This is desirable to prevent freezing of the rain water in the outdoor unit during winter. Further, the groove between the plateaus may be conveniently used for placing various tools and parts during installation.

In this case, it is advantageous to choose the width of the front column of the slits greater than the width of the rear column. The width of the front plateau region associated with the front column of the slits in the side wall is thus larger than the rear plateau region.

This combination of wider front column and narrower rear column of slits has several advantages over conventional windows. First, the outdoor unit having this design looks thinner and has a neat configuration. Second, the side air intake window provide a more efficient use of slits than the conventional one in that the air intake window does not have an air-blocking strip in the middle of the window where the flow rate of the air is greatest, thereby reducing the effect of the strip in the window. The strip is shifted to a backward position where the flow rate is not very large.

In a further aspect of the invention, there is provided an outdoor unit for use in a separate type air conditioner which includes an outdoor unit and an indoor unit each having at least a compressor, a heat exchanger having a circumferential frame, and a expansion device, said outdoor and indoor units connected with each other by refrigerant tubes so that they altogether form the air conditioner, the outdoor unit comprising: a baseplate; a housing having a side wall in which a first air intake window is formed, a rear wall extending upright from said baseplate and having a second air intake window, and a front wall having an air outlet window; and a partition board having a peripheral frame and extending upright from the baseplate for portioning the internal space of the housing into a fan compartment for accommodating the heat exchanger and a fan for supplying air to the heat exchanger, and a machinery compartment for accommodating the compressor, wherein the heat exchanger extends over the rear air intake window in the rear wall when the heat exchanger is mounted upright on the baseplate; and wherein the partition board is disposed in front of the heat exchanger by securing the peripheral frame of the partition board on a front end of the peripheral frame of the heat exchanger by screws applied from the rear of the heat exchanger; and the air outlet window in the front wall is configured to a right polygon and has a guard mounted on the outlet window, such that the guard has a grid consisting of longitudinal and transverse ribs forming a plurality of rectangular slits and that the guard may be switched in its orientation, so that when the guard is switched in orientation it changes the orientation of the rectangular slits.

With this arrangement, the direction of the air blown out of the front air outlet window may be conveniently changed by switching the orientation of the guard in accordance with the environmental conditions for the outdoor unit.

One of the most practical configurations of the guards is a square.

BRIEF DESCRIPTION OF THE DRAWINGS

These and other features of the present invention may be more readily understood by reference to the following description, taken in conjunction with the accompanying drawings, in which.

DETAILED DESCRIPTION OF THE PREFERRED EMBODIMENT

Figure 1:
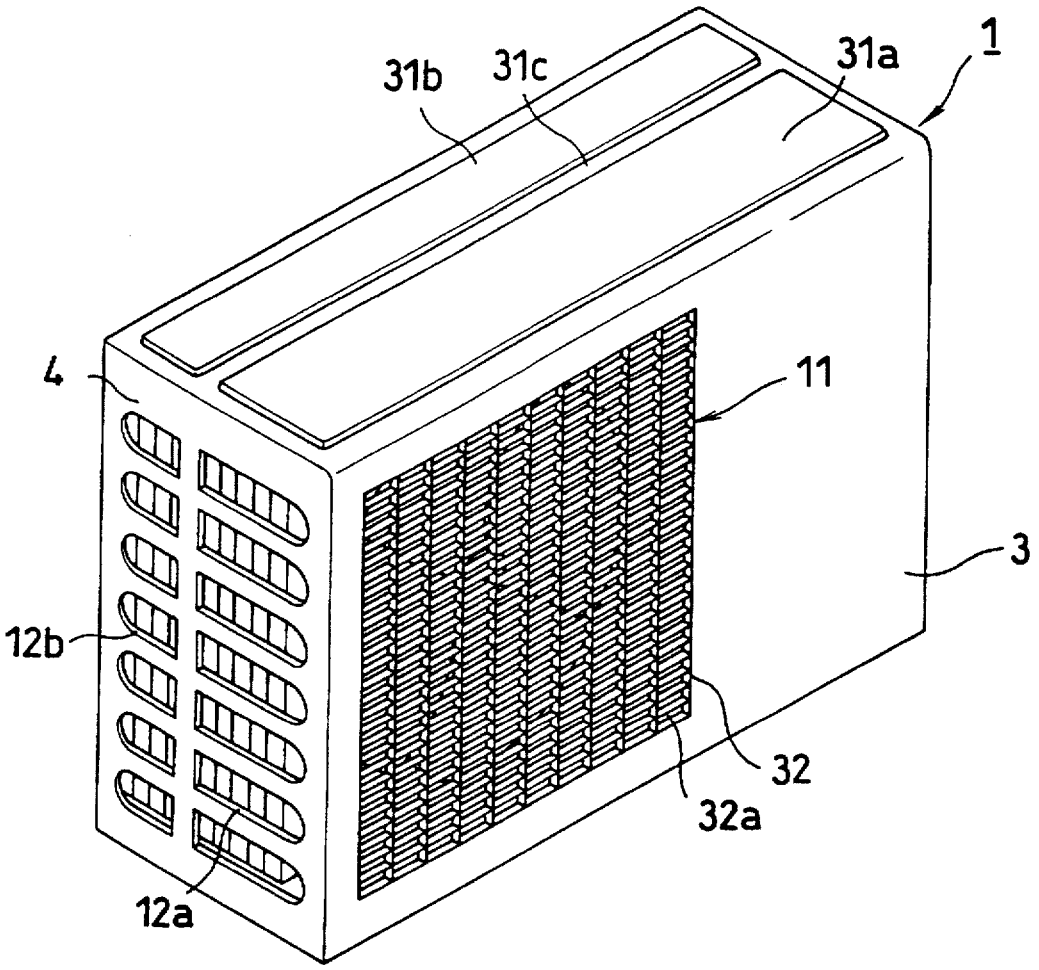
FIG. 1 is a schematic perspective view of an outdoor unit for a separate type air conditioner according to the invention, showing a side air intake window on one side wall and a front air outlet window in the front wall of the unit.
Figure 2:
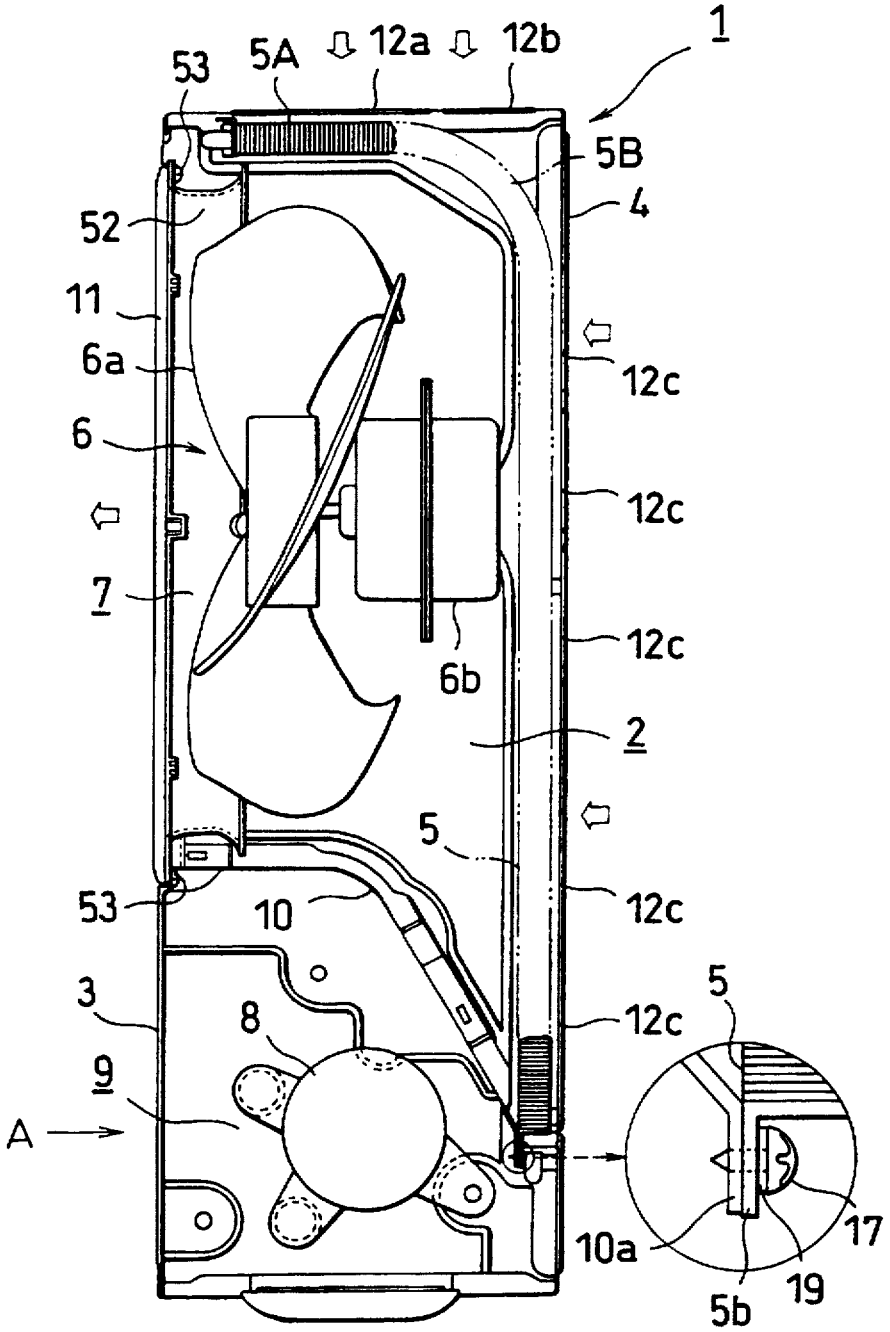
FIG. 2 is a plan view of the outdoor unit of FIG. 1.
Figure 3:
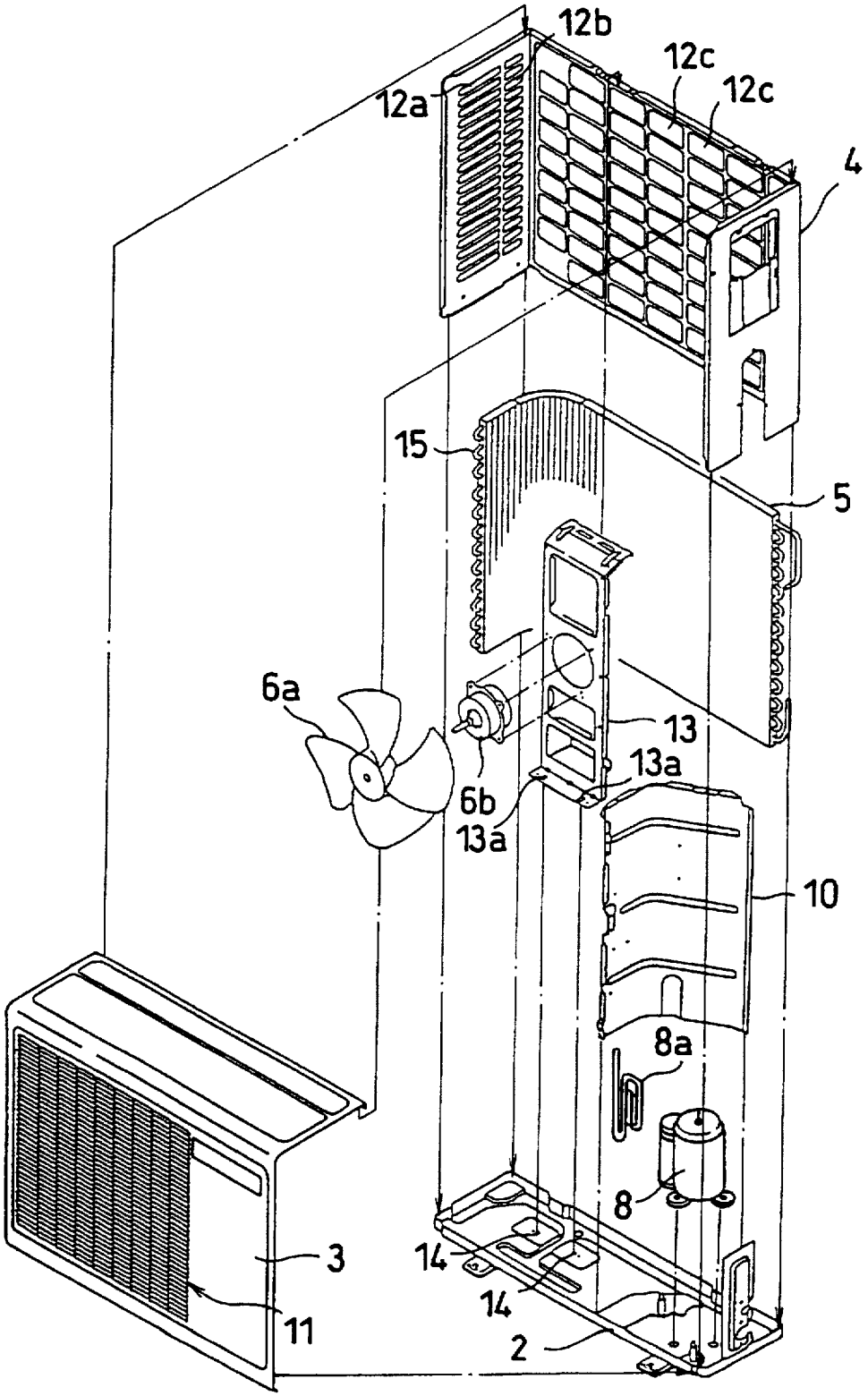
FIG. 3 is an exploded view of the outdoor unit of FIG. 1.

Referring now to FIGS. 1, 2, and 3, there is shown an outdoor unit 1, which has a first housing member 3 having a front wall and a ceiling, and a second housing member 4 having opposite side walls and a rear wall, both housing members connected with each other and with a baseplate 2 by suitable screws. The internal space of the housing is divided by a partition board 10 into a fan compartment 7 and a machinery compartment 9. Installed in the fan compartment are an L shaped heat exchanger 5 having one end section facing one side wall and another end section facing the rear wall of the second housing member 4, a fan 6 having a propeller 6a attached on a fan motor 6*b*. Installed in the machinery compartment is a compressor 8 and other mechanical elements, such as an accumulator and a four-way valve.

Formed in the front wall of the first housing member 3 is an air outlet window 11 for ejecting the air that has passed through the heat exchanger 5. The front air outlet window has a guard 32. The side air inlet window formed in the side wall of the second housing member 4 has two columns of slits 12*a* and 12*b*, while the rear wall has a rear air intake window 12*c*. The heat exchanger faces these air intake windows.

Threaded holes 14 are formed in the baseplate 2 at about the center of the fan compartment 7 for securing a fan mount member 13 by screws. The fan mount member 13 is preferably made of a metal, such as a stainless steel and has a central hole for receiving therein the fan motor 6*b*. The fan mount member 13 has a folded section at its lower end having holes 13*a*. At the upper end, the fan mount member 13 also has a folded section having similar holes. In mounting the fan mount member 13 on the baseplate, the holes 13*a* are aligned with respective threaded holes 14, so that the member is fastened in position by screws. The upper folded end of the fan mount member 13 is secured to a tongue provided on the ceiling of the second housing member 4 by screws. As the fan mount member 13 is secured to the baseplate 2 and to the upper section of the second housing member 4, the fan motor 6*b* secured in the hole of the fan mount member 13 is held in a prescribed position.

Figure 4:
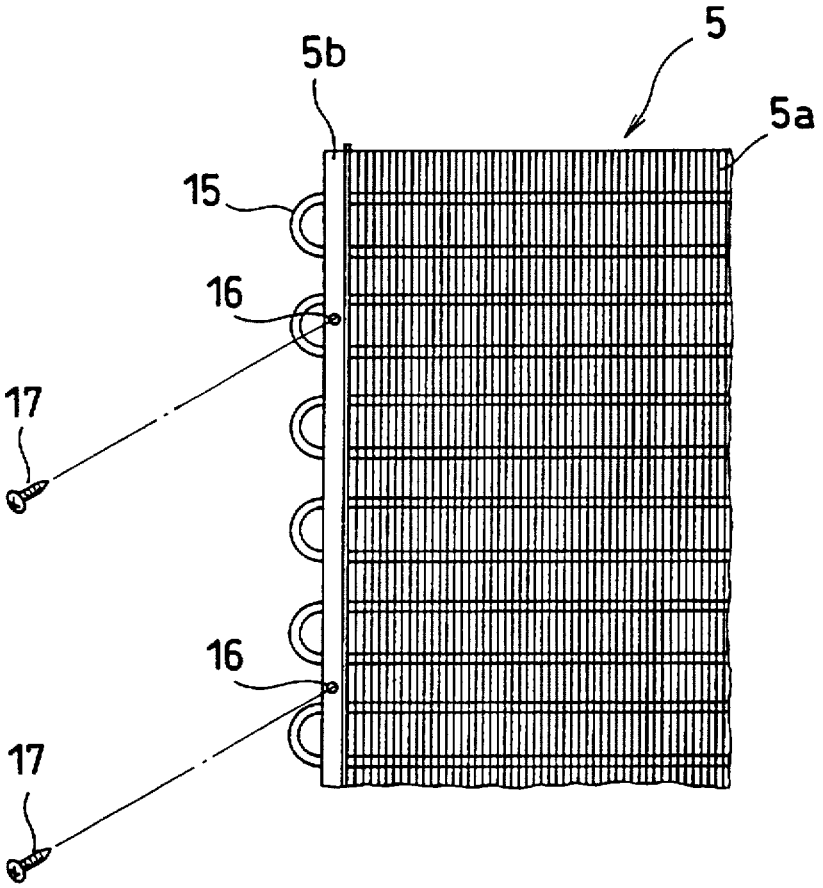
FIG. 4 is a partial front view of the outdoor unit of FIG. 1.
Figure 5:
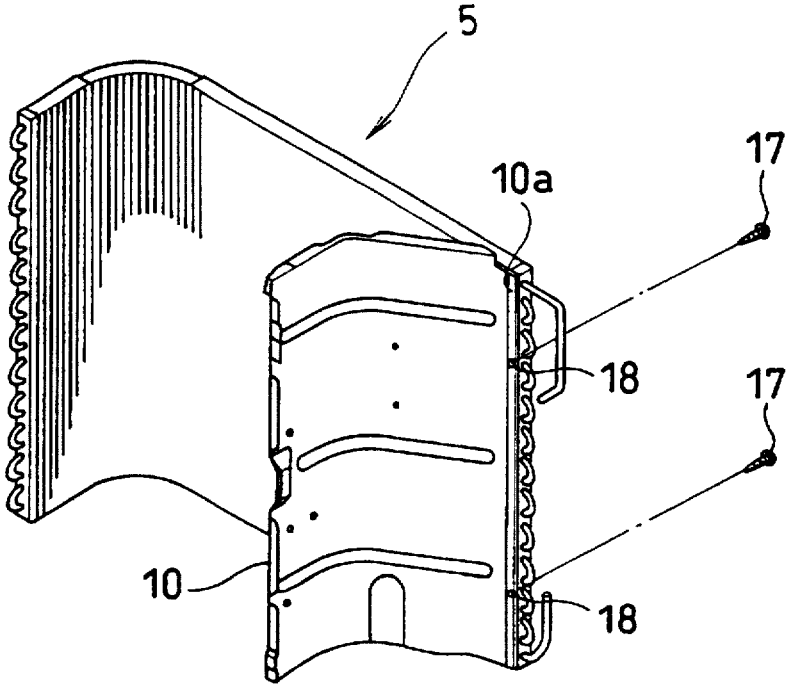
FIG. 5 is a perspective view of the heat exchanger after partition board is mounted on the front end of the heat exchanger of FIG. 1.

As shown in FIG. 4, the heat exchanger 5 has a zigzagging refrigerant tube 15 for passing there through a refrigerant and a multiplicity of fins 5*a* which span the entire regions of the zigzagging tube 15, creating a large heat transport surface needed for good heat exchange between the tube 15 and the ambient air. The tube 15 and the fins 5*a* form a generally thin L shaped panel, as shown in FIG. 5. The heat exchanger 5 is secured upright on the baseplate 2 by fastening its frame 5*b* to the baseplate 2 by screws. The frame 5*b* also has non-threaded holes 16 for receiving screws to secure the partition board 10 on the frame 5*b*. Similarly, the compressor 8 is installed on the baseplate 2 in the machinery compartment 9 by means of screws. The compressor is connected with the tube 15 of the heat exchanger 5 by connecting tubes.

Figure 6:
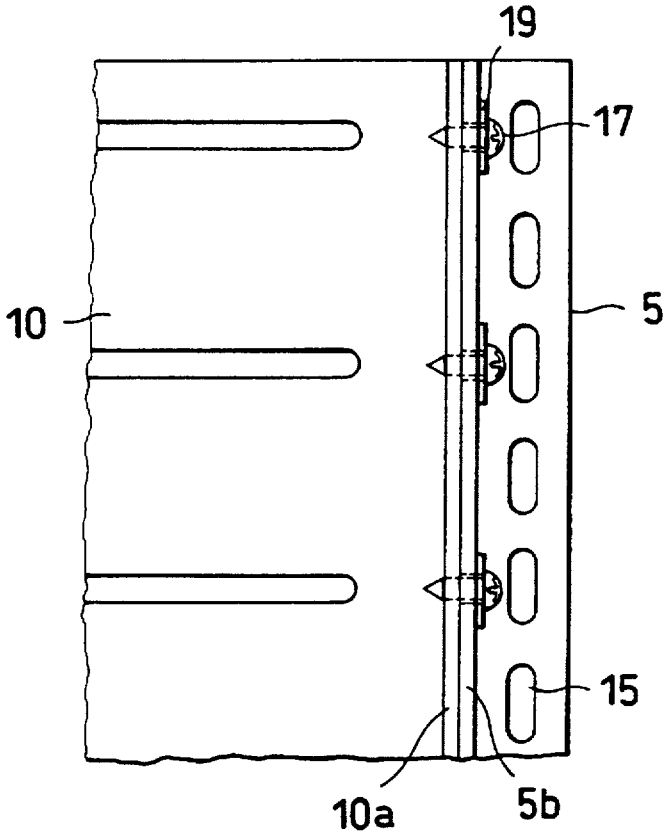
FIG. 6 is an end view of the heat exchanger after the partition board is mounted on the front end of the heat exchanger of FIG. 1.

The partition board 10 is secured at one end 10*a* thereof to one end of the heat exchanger 5, as shown in FIGS. 5 and 6. This is done by, first, aligning the non-threaded holes 16 to corresponding threaded holes 18, and then fastening screws 17 in the threaded holes 18. Washers 19 may be inserted on the screws 17 to prevent the screws 17 from becoming loose. The partition board 10 is also secured to the baseplate 2 by screws.

It is noted that the non-threaded holes 16 and the threaded holes 18 are provided behind the compressor 8, i.e. in a region shadowed by the compressor 8, as seen from the front end of the unit, and in the direction indicated by arrow A in FIG. 2.

Figure 7:
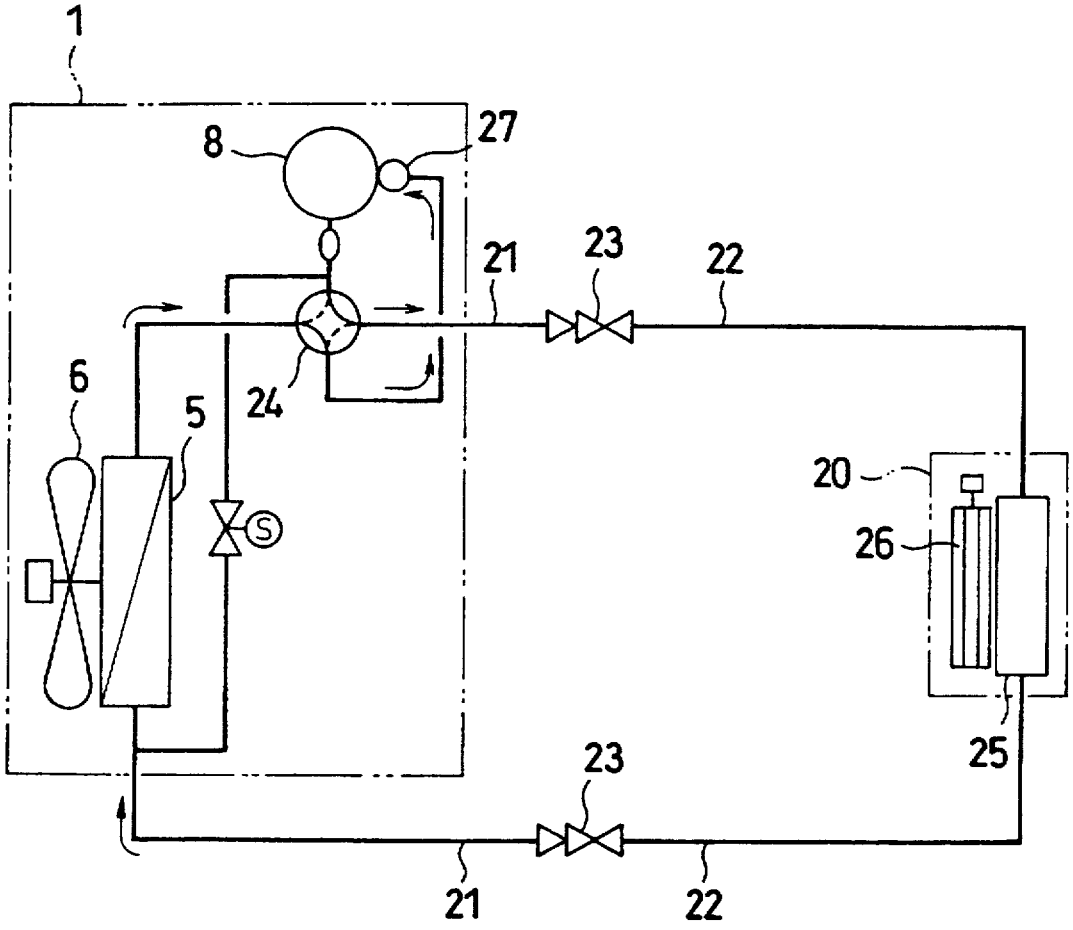
FIG. 7 is a refrigerant circuit of an air conditioner of FIG. 1.

FIG. 7 illustrates a fluid circuit for the air conditioner which comprises the outdoor unit 1 connected with the indoor unit 20. Upper and lower tubes 21 of the outdoor unit, as well as upper and lower tubes 22 of the indoor unit, are connected with each other via a pair of connection valves 23 for establishing the fluid circuit.

When the air conditioner is in a heating mode, a four-way valve 24 provided in the outdoor unit 1 is switched to a state in which the refrigerant compressed in the compressor 8 is directed to the upper tube 21 via the four-way valve 24 and passed to the indoor heat exchanger 25 of the indoor unit 20 through the upper connection valve 23 and the upper tube 22. The refrigerant is condensed in the indoor heat exchanger 25 of the indoor unit 20, giving off heat there. The heat is released to the air conditioned room by a fan 26. The refrigerant, liquefied in the indoor heat exchanger 25, is returned to the heat exchanger 5 through the lower tube 22, the lower connection valve 23, and the lower tube 21. The refrigerant is decompressed and vaporized in the heat exchanger 5. The gaseous refrigerant is then passed to an accumulator 27 via the four-way valve 24, and finally supplied to the compressor 8, where the gas is again compressed before it is circulated in the fluid circuit.

During the cooling operation of the air conditioner, the four-way valve 24 of the outdoor unit 1 is switched to another state indicated by a phantom line in FIG. 7, in which the compressed refrigerant is first supplied to the heat exchanger 5 via the four-way valve 24 and liquefied therein releasing heat to the heat exchanger 5. The heat thus released is fanned out of the heat exchanger 5 by the fan 6. The refrigerant, cooled and liquefied in the heat exchanger 5, is then supplied to the indoor heat exchanger 25 of the indoor unit 20 through the upper tube 21, the upper connection valve 23, and the upper tube 22. The gas is decompressed and evaporate in the indoor heat exchanger 25, absorbing heat from the air delivered to the indoor heat exchanger 25 by the fan 26. Subsequently, the gaseous refrigerant is returned from the indoor heat exchanger 25 to the compressor 8 of the outdoor unit 1 through the lower tubes 22 and 21, and via the four-way valve 24 and the accumulator 27.

Since the outdoor unit 1 is installed on an outdoor site for operation, it is exposed to rain and wind. Thus, it is likely that the slits or gaps between the fins of the heat exchanger are clogged with dust. Then the heat exchanger 1 must be dismounted for cleaning. To do so, it is necessary to, first, remove the first housing member 3, and then the second housing member 4. The upper end of the fan mount member 13 must be also disconnected from the second housing member 4 prior to the removal of the second housing member 4. But this is a simple step and does not take time.

After the second housing member 4 is removed, the partition board 10 is removed from the outdoor unit 1 by removing the screws 17 off the outdoor unit 1 from behind. The outdoor unit 1 may be easily removed from the baseplate 2 once the screws securing the outdoor unit 1 are removed from the baseplate 2. In assembling the cleaned unit 1, the heat exchanger 5 is first mounted on the baseplate 2, and the partition board 10 is mounted on the heat exchanger 5 by tightening the screws 17 from behind thereof.

It would be appreciated that the screws 17 are tightened or loosened on the back of the heat exchanger 5 from behind so that the partition board 10, disposed in front of the heat exchanger 5, may be easily mounted on and dismounted from the heat exchanger 5 without dismounting the compressor 8. In conventional units, however, such partition board 10 must be removed from a heat exchanger 5 by loosening screws from the front. Since these screws are located right behind the compressor 8, they are blocked by the compressor and not accessible to an attendant with a screw driver. Consequently, the partition board 10 cannot be removed from the heat exchanger 5 unless the compressor 8 is also removed. Thus, the invention provides a simple and easy way to detach only the heat exchanger 5 from the partition board 10 for cleaning.

As described above, in order to increase the total surface area of the fins 5*a* of the heat exchanger 5 as much as possible, the heat exchanger 5 has a generally L shaped configuration, as shown in FIG. 2, so that the heat exchanger 5 receives air from the rear air intake window 12*c* in the rear wall as well as from the front and rear columns of slits 12*a* and 12*b* in the side air intake window. It should be noted that, in this arrangement, the shorter straight section of the heat exchanger 5, which corresponds to the horizontal bar of the L-faces the wider column 12*a* of the side air intake window that occupies a great portion of the side window. The longer straight section of the heat exchanger 5 which corresponds to the vertical line of L faces the rear air intake window 12*c*. The curved section 5*B* between the shorter and longer sections, corresponds to the kink of the L, and faces the narrower column of slits 12*b*. The main flow of air from the side window is, thus, provided directly to the shorter straight section, not to the kink section. This arrangement of the side air intake window may provide more efficient air flow to the heat exchanger than equally sized columns of slits, for the reason discussed below.

As a result of the curving of the section 5B of the heat exchanger 5, the gaps between the adjacent fins 5*a* decrease i.e. narrow as the air passes through this section towards the interior of the outdoor unit 1. This tends to block the stream of the air, so that the bent section 5B has a greater air resistance than the straight section 5A.

Therefore, it is advantageous to allow the air to pass as much as possible through the straight section 5A of the heat exchanger 5. Thus, the invention aims to permit a large air flow rate through the column 12*a* to the straight section 5A for an increased thermal efficiency.

This is accomplished by making the horizontal width W1 of the front column in the side air intake window 12*a* larger than the corresponding width W2 of the column 12*b*. It should be appreciated that this type of side air intake window is also preferable in design, since a side air intake window having larger openings in the front column gives an impression that the unit has a favorably thin geometry.

Figure 8:
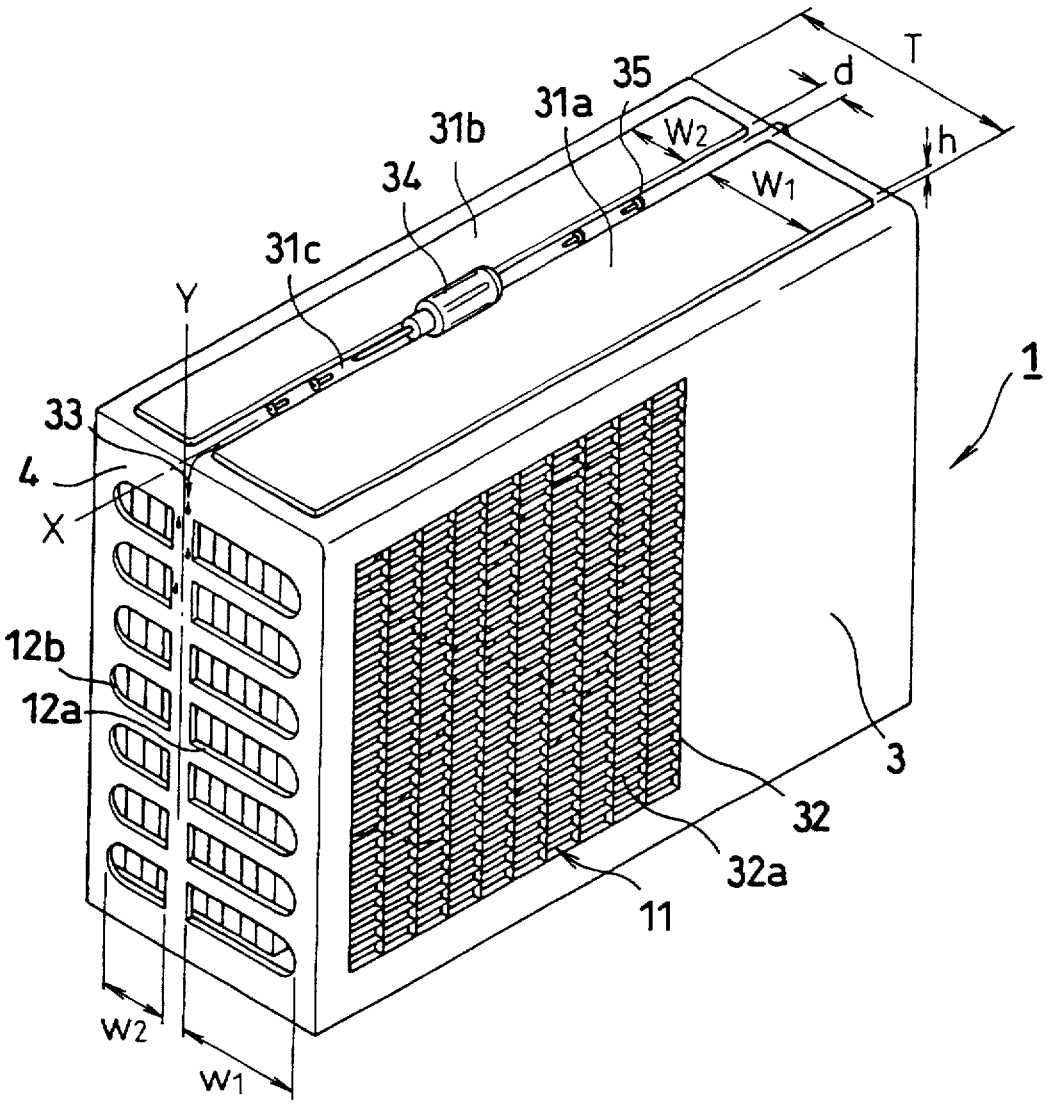
FIG. 8 is an overall perspective view of the outdoor unit, useful in explaining the structure and the functions of the housing of the outdoor unit of FIG. 1.
Figure 9:
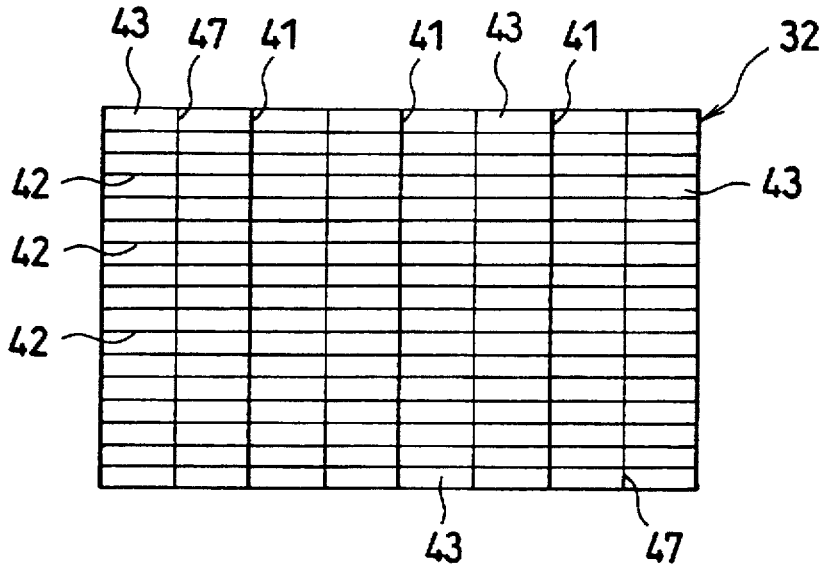
FIG. 9 is a front view of a guard mounted on a square air outlet window in the front wall of the outdoor unit according to the invention.
Figure 10:
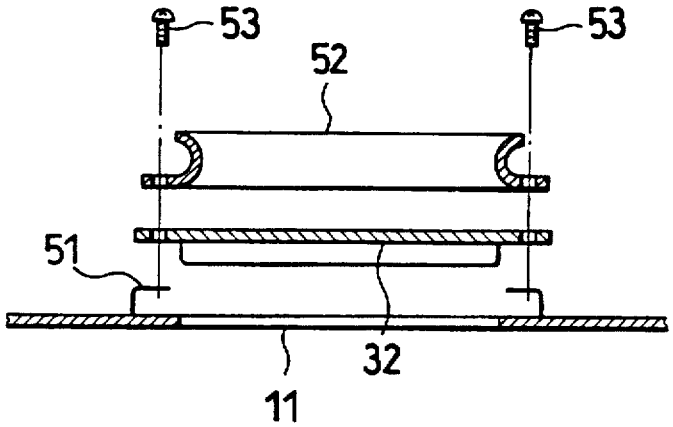
FIG. 10 is a plan view showing relative arrangement of a guard and a square air outlet window in the front wall of the outdoor unit according to the invention.

There are two parallel plateau regions 31*a* and 31*b* extending across the upper surface of the ceiling. The widths of the plateau regions correspond to respective side air intake windows 12*a* and 12*b* as shown in FIG. 8. That is, the widths of the front and rear plateau regions are W1 and W2, respectively.

By providing such parallel plateau regions 31*a* and 31*b* across the ceiling, the strength of the ceiling is enhanced in comparison with a conventional flat ceiling, so that relatively heavy objects such as flower pots may be placed on the outdoor unit after the installation thereof. Further, a groove 31*c* between the two plateau regions 31*a* and 31*b* serves as a drainage for safely leading rain water 33 from the ceiling to the ground.

This drainage 31*c* between the parallel plateaus regions 31*a* and 31*b* helps reduce the amount of rain water dripping from the ceiling down the front wall, which water no only stains the front wall but also enters the housing through the air outlet guard 32. Should the rain water enter the housing and freeze on the fan 6 during winter, it would cause malfunction of the outdoor unit. Thus, these parallel plateau regions help reduce probable malfunction of the unit.

The fact that the drainage 31*c* is closer to the rear end than to the front of the housing also helps reduce the amount of such rain water that drips on the front wall.

It is noted that the drainage groove 31*c* is aligned with the strip between the two column-wise slits 12*a* and 12*b* in the side air intake window, so that the rain water running down from the ceiling tends to pass through the strip without entering the housing through the side air inlet window. This contributes to reduction of dust that is contained in the rain and deposited in the gaps of the fins 5*c* of the heat exchanger. Otherwise, a greater amount of dust disadvantageously accumulates in the gaps and lowers heat transport coefficient of the heat exchanger 5.

It is also advantageous to provide the groove 31*c* between the two plateau regions 31*a* and 31*b*, because the groove 31*c* may be utilized as a convenient space for keeping tools such as a screw driver 34 and mounting parts 35 such as bolts and nuts. This prevents the tools and the parts from being lost during the installation and maintenance of the outdoor unit.

Thus, while the two plateau regions on the ceiling of the invention may add strength to the housing and preventive means for dust reduction in the housing, they also solve a problem that tools and parts can be lost during installation and maintenance.

Figure 11:
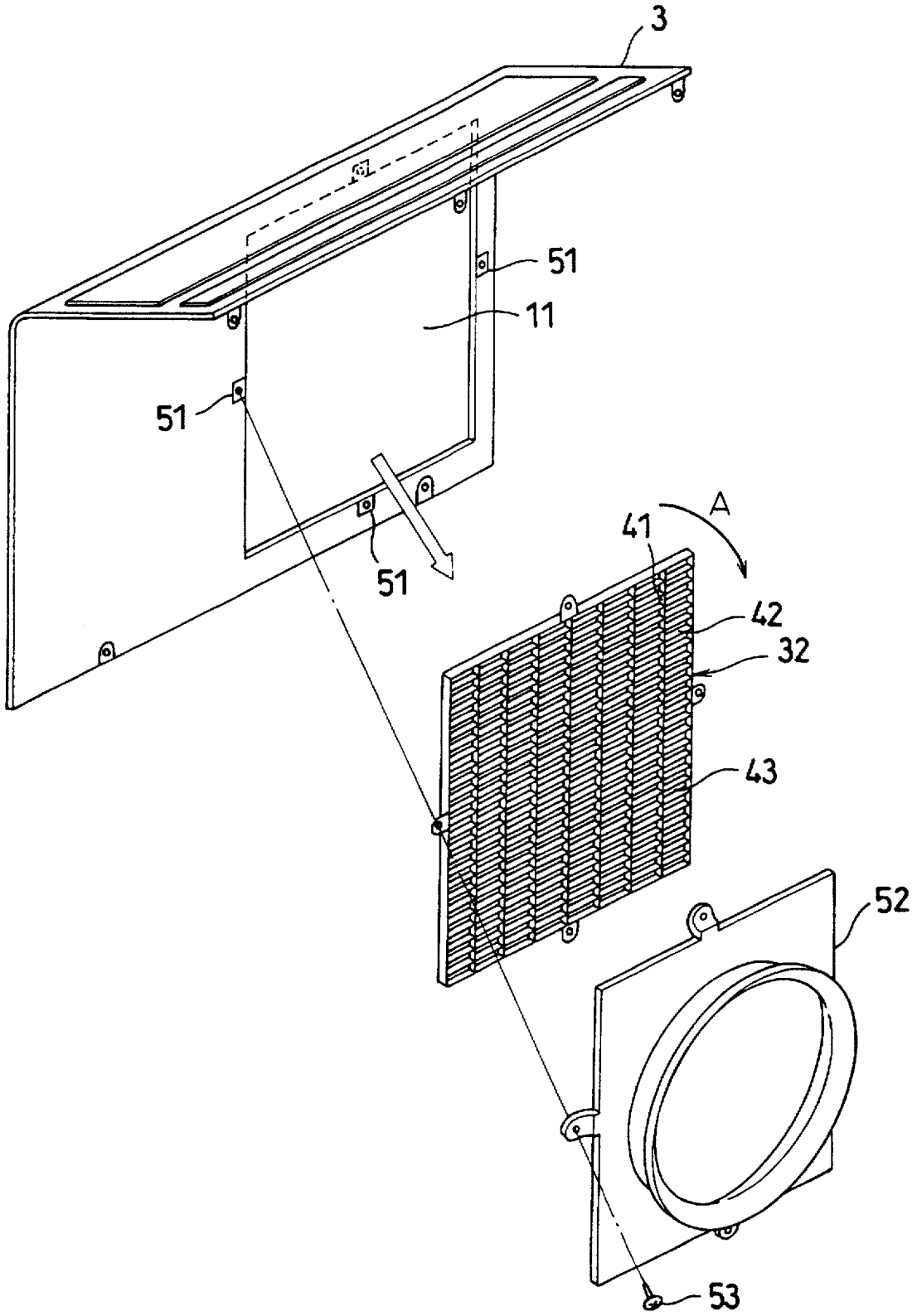
FIG. 11 is a perspective view of an exploded guard to be mounted on a square air outlet window in the front wall of the outdoor unit according to the invention.

An air outlet guard 32 is mounted on the air outlet window 11 to prevent foreign objects from entering the outdoor unit 1 through the window 11, as shown in FIG. 11. In the example shown, the air outlet window 11 and the air outlet guard 32 have square configurations.

Figure 12:
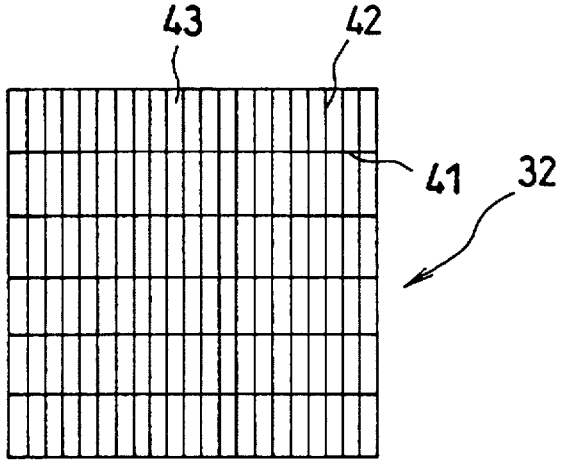
FIG. 12 is a front view of the guard turned by 90°, from the direction shown in FIG. 11 as it is mounted on the air outlet window in the front wall of the outdoor unit.

As shown in FIG. 11, the air outlet guard 32 is mounted on ribs 51 formed on the periphery of the window 11 by screws 53 along with an air outlet guide 52. The air forced by the fan 6a to pass through the heat exchanger 5 is discharged from the air outlet guard 32 and diffused through the air outlet guide 52. In the square air outlet guard 32 shown herein has many vertical and horizontal ribs 41 and 42, respectively, forming a grid having a plurality of elongate openings 43. The vertical ribs 41 are arranged to deflect the air passing through the elongate openings 43 in a direction parallel to the horizontal ribs, i.e. parallel to the longitudinal direction of the elongate openings. Thus, when the outlet guard is mounted with its elongate ribs directed horizontally, the air is blown out of the window in a horizontal direction. If, instead, the air is to be directed in a downward direction, the air outlet guard 32 is turned by 90 degrees with respect to the position shown in FIG. 11 when it is mounted on the air outlet window 11, as shown in FIG. 12.

In order to change the orientation of the air outlet guard 32, the first housing member 3 is dismounted from the outdoor unit 1, and then the air outlet guide 52 and the air outlet guard 32 are removed from the housing member 3 by removing the screws 53.

The air outlet guard 32 is then turned by 90 degrees, as indicated by arrow A in FIG. 11, so that the elongate openings 43 are oriented vertically. The air outlet guide 52 is then mounted again on the housing member 3 from behind.

Next, the air outlet guide 52 and the air outlet guard 32 are mounted on the housing member 3 by fitting and tightening the screws 53 (only one screw is shown in FIG. 11) in the respective threaded holes in the ribs 51 of the housing member 3. Finally, the housing member 3 is mounted on the outdoor unit 1.

When the air outlet guard 32 is mounted on the air outlet window 11 with the elongate openings 43 oriented vertically, the air coming out of the air outlet window 11 is diffused in a downward direction, so that the air does not give any harm to an object lying near the side wall of the unit 1.

It would be apparent that the configuration of the air outlet guard 32 is not limited to square as shown in FIG. 12. That is, the air outlet window 11 and the air outlet guard 32 may have different configurations, such as equilateral polygons, e.g. an equilateral pentagon.

Figure 13:
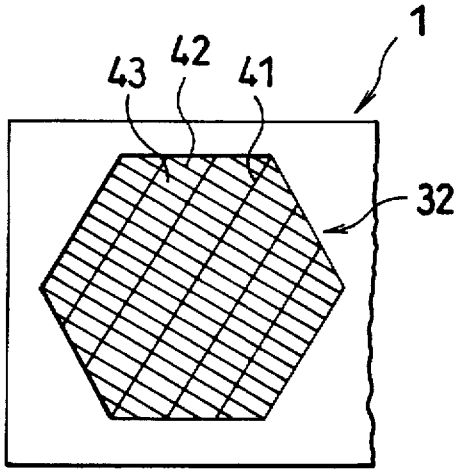
FIG. 13 is a front view of the outdoor unit having a hexagonal air outlet window in the front wall according to the invention.

By choosing similar equilateral polygons for the air outlet window 11 and air outlet guard 32 having more than five sides, the air outlet guard 32 may selectively direct the air in several different directions including vertical and horizontal directions. FIG. 13 illustrates a hexagonal air outlet guard 32, which may have three directions differing one another by 120 degrees. This type of air outlet guard 32 provides a certain degrees of freedom in the choice of the direction of the blown air, which is very convenient when the outdoor unit is spatially limited in some directions by certain objects, whereby the air from the air outlet window 11 must be directed to other directions.

Figure 14:
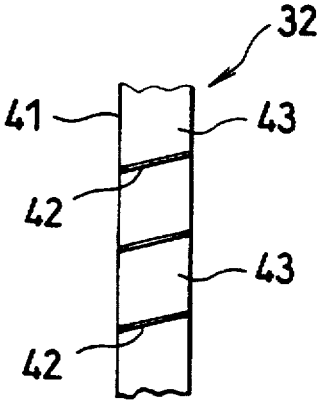
FIG. 14 is a partial transverse cross section of the guard mounted on the air outlet window in the front wall according to the invention.

Instead of re-orienting the elongate openings 43 of the air outlet window to a desired orientation, as discussed above, the square air outlet guard 32 may be used in directing the air in a downward direction with the elongate openings still oriented horizontally, provided that the surfaces of the horizontal ribs 42 are inclined downward at a given angle with respect to a horizontal plane, as shown in FIG. 14. Apparently, such arrangement of the horizontal ribs 42 in the elongate openings 43 causes the air to be directed downward as it is blown through the outlet guard 32. Thus, this type of outlet guard need not be re-mounted for changing the direction of the air from the outlet window.

Figure 15:
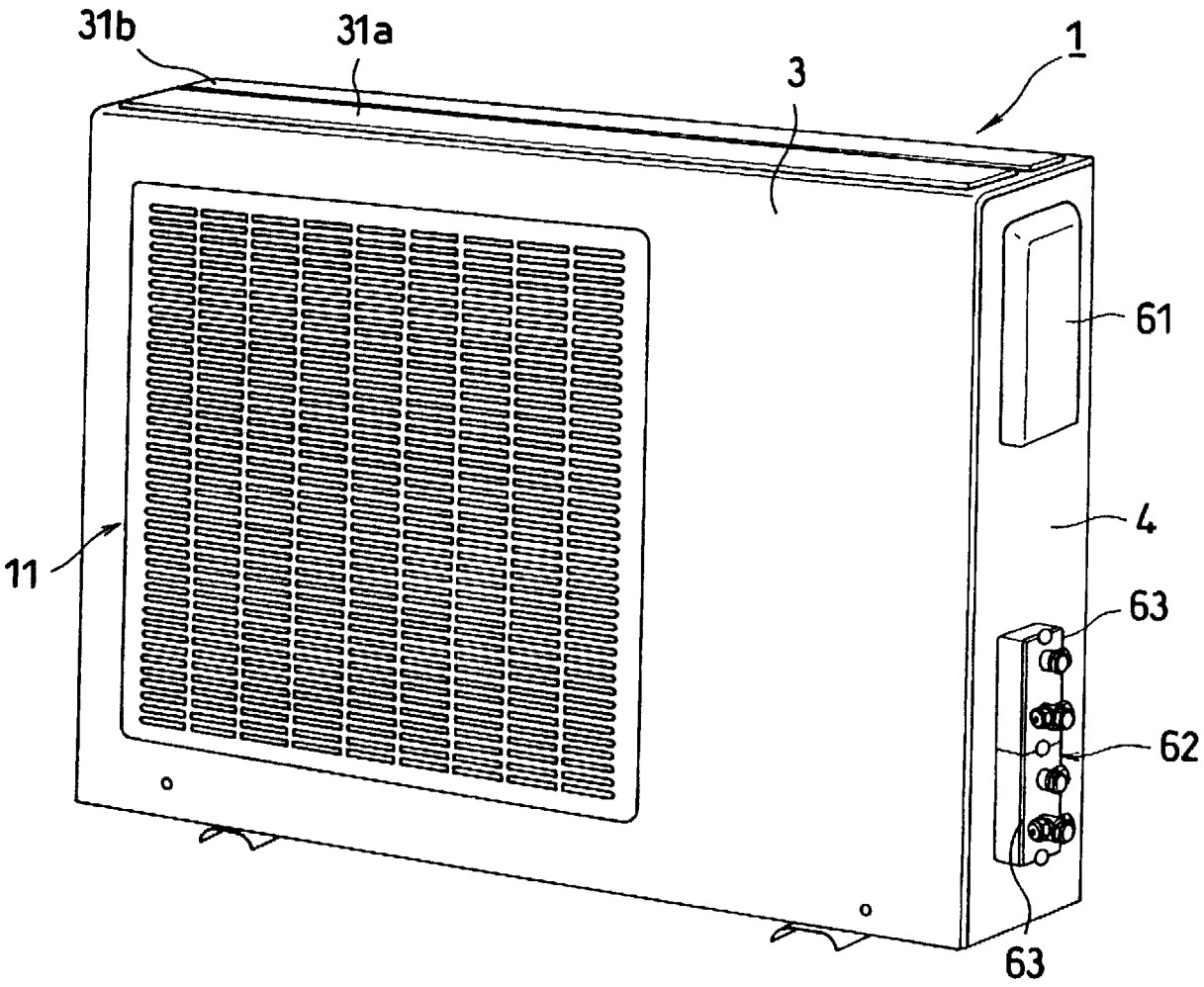
FIG. 15 is another overall perspective view of the outdoor unit of the invention, showing the arrangement of electrical and fluid mechanical connectors on the other side wall of the outdoor unit.
Figure 16:
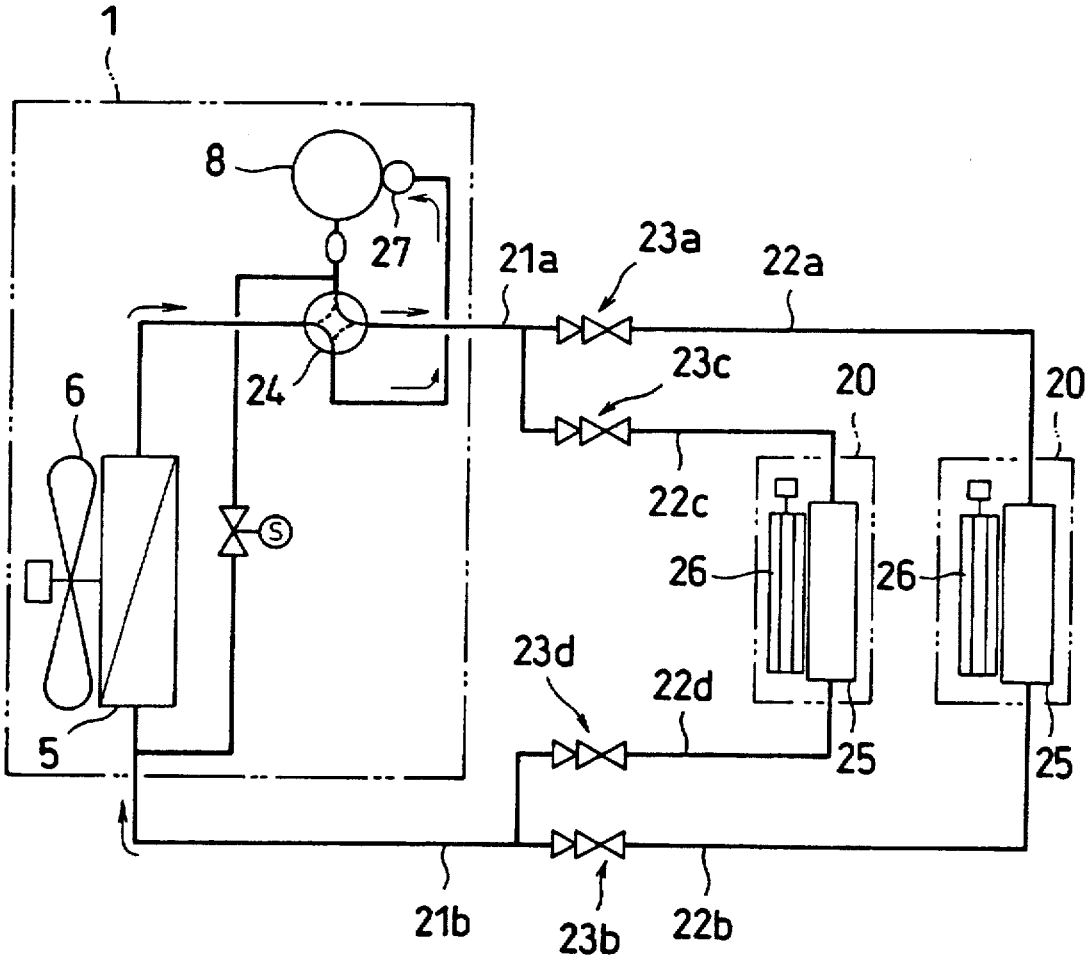
FIG. 16 is a refrigerant circuit of the outdoor unit of the invention when two indoor units are connected to one outdoor unit.

At the upper section of the other side of the housing member 3, which is opposite to the side where the side air intake window 12*a* and 12*b* is formed, there is provided a set of electrical connectors 61 for receiving electric power and control signals, and at the lower section of the side wall a set of fluid connectors 62. The fluid connectors 62 are provided with two refrigerant tube connectors 63, one above the fluid connector 62 and another below the fluid connector 62, as shown in FIG. 15. FIG. 16 shows a fluid circuit for the case where two indoor units are connected with the outdoor unit. However, except that two indoor units are connected with one outdoor unit, basic structure and function of the fluid circuit is the same as for the preceding fluid circuit including only one indoor unit, and hence the fluid circuit will not be described in detail any further.

Figure 17:
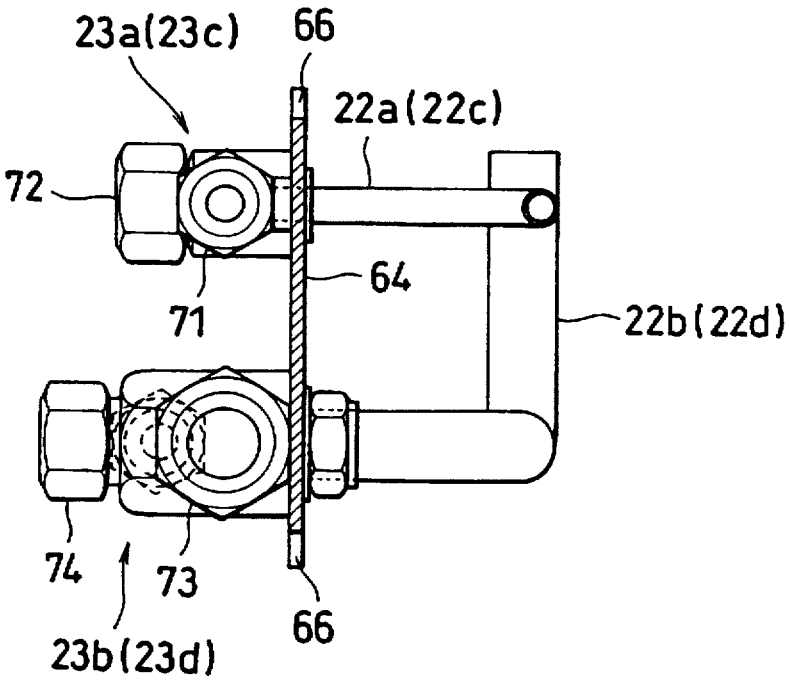
FIG. 17 is a transverse cross section of refrigerant tube connectors provided on the other side of the outdoor unit of the invention.
Figure 18:
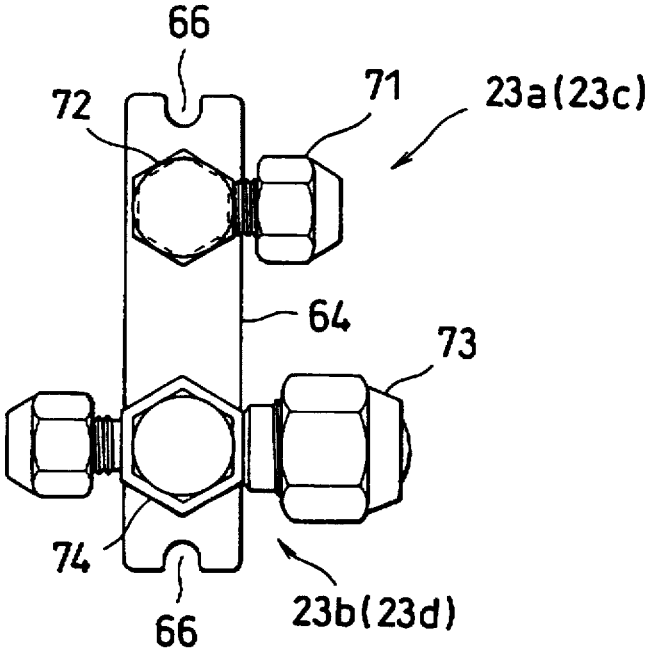
FIG. 18 is a plan view of a refrigerant connectors shown in FIG. 17.

Each of the refrigerant tube connectors 63 shown in FIGS. 17 and 18 has first and second connection valves 23*a* (or 23*c*) and 23*b* (or 23*d*), respectively, which are welded to a rectangular base 64.

As shown in FIG. 17, the first connection valve 23*a* (or 23*c*) is provided at one end thereof with a refrigerant tube connector 71 which is in turn connected with a refrigerant tube 22*a* (22*c*) and at the other end thereof with a valve control screw 72 for opening/closing the connection valve 23*a* (23*c*). Similarly, the second connection valve 23*b* (or 23*d*) has a refrigerant tube connector 73 and a valve control screw 74. The connection valve 23*b* (23*d*) is connected at the other end with the refrigerant tube 22*b* (or 22*d*).

In operation, the refrigerant flows in the fluid circuit shown in FIG. 16. When the unit is in cooling operation, the refrigerant is pumped out of the compressor 8 and passed into the refrigerant tube 21*a* via the four-way valve 24 and further into the indoor units 20 via the respective connection valves 23*a* and 23*c* and respective refrigerant tubes 22*a* and 22*c*, as indicated by arrows in FIG. 16. As the refrigerant is delivered to the heat exchangers 25 of the indoor units 20, the refrigerant is decompressed to absorb heat therein and then returned to the heat exchanger 5 of the outdoor unit 1 through the refrigerant tubes 22*b* and 22*d* of the respective indoor units and via the respective second valves 23*b* and 23*d*, and through the tube 21*b* of the outdoor unit 1. The refrigerant proceeds from the heat exchanger 5 to the compressor 8 via the four-way valve 24 and the accumulator 27.

It would be noted that in conventional outdoor units each of the first and the second valves 23*a* (or 23*c*) and 23*b* (or 23*d*) must be independently secured by a pair of screws. Therefore, it requires two independent mounting areas and four independent screws along with four manipulations in mounting the two valves for each indoor unit. This implies that mounting of multiple valves requires a fairly large total mounting area and time. In contrast, the invention provides a single baseplate 64 for the first and the second valves 23*a* (23*c*) and 23*b* (23*d*), respectively which may be mounted by only two screws 65. Thus, it requires only half the time in mounting the valves as compared with conventional ones. In addition, the baseplate for the two valves 23*a* (23*c*) and 23*b* (23*d*) is smaller in size than the conventional one by the diameter of the screw multiplied by two, since according to the invention only two screws 65 are necessary in mounting the first and the second valves 23*a* (23*c*) and 23*b* (23*d*), respectively. Hence, much of the area and time may be saved in comparison with conventional mounts, especially in a case where more than two indoor units are connected.

Figure 19:
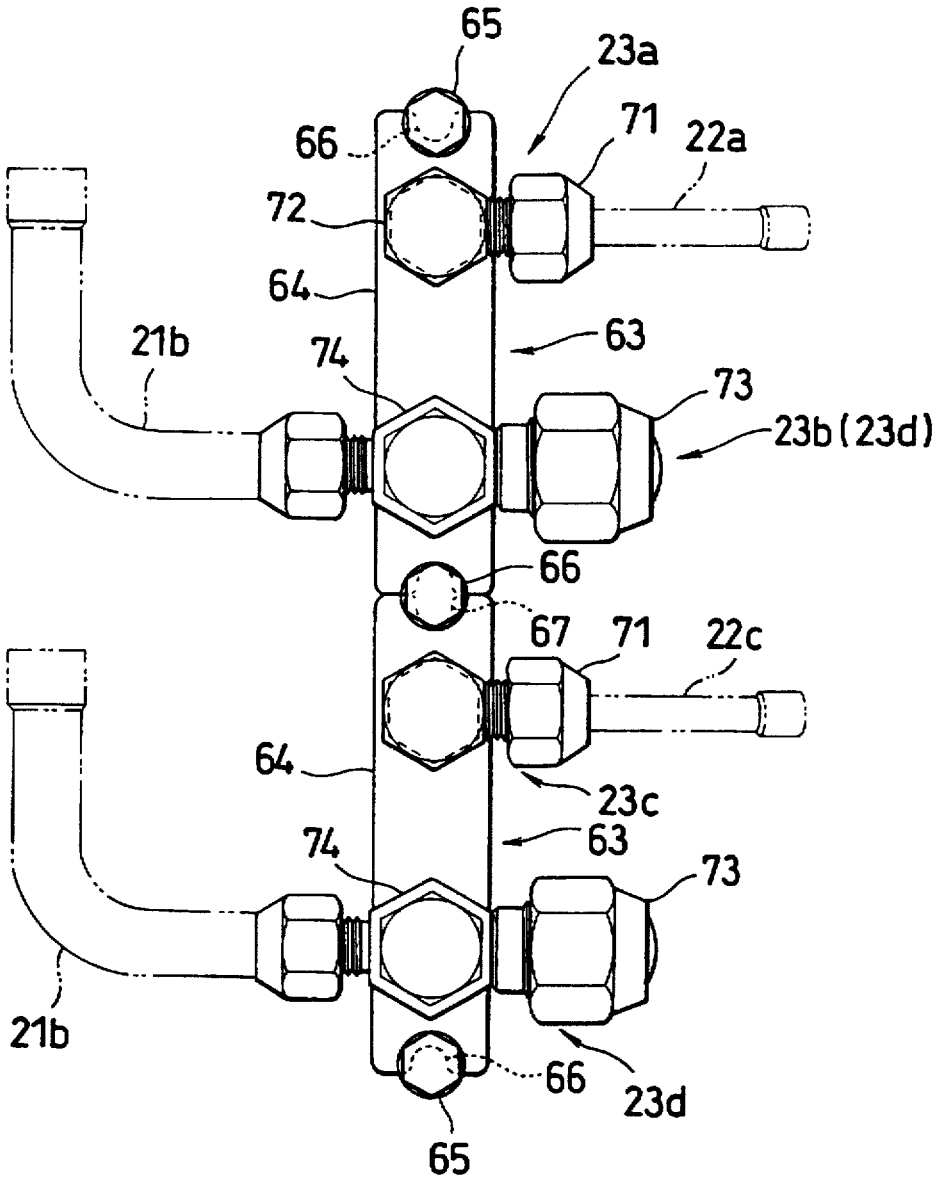
FIG. 19 is a figure useful. in explaining how two sets of refrigerant tube connectors are provided on the other side wall according to the invention.

Furthermore, as shown in FIG. 19, the baseplate 64 of the refrigerant tube connector 63 is provided at the opposite ends thereof with a substantially semi-circular cut 66 for receiving a screw to secure the baseplate. The cut is a little deeper than a semi-circular cut so that the center of the screw fitted in the cut is located a little inside the edge of the baseplate. As a screw is applied to the semi-circular cut and tightened, the refrigerant tube connectors 63 is mounted on the outdoor unit 1 in a firm and stable condition. This is because the center of the screw sits inside the edge of the baseplate 64, and hence the screw may sit in a stable position in the cut and will not be inclined.

When two refrigerant tube connectors 63 are mounted on the housing 4, one end of one baseplate 64 is mated with one end of the other baseplate 64 such that the two cuts 66 of the two baseplates of the refrigerant tube connectors 63 form an elliptic hole 67 as shown in FIG. 19.

It would be appreciated that only one screw 65 is needed to secure the mated ends of the two baseplates 64 as described above, since then the screw 65 will firmly clamp both baseplates 64.

Thus, only three screws are required in total in mounting the two baseplates 64 (or two refrigerant tube connectors 63). This also helps save time which is otherwise required to mount the two refrigerant tube connectors 63.

Further, the fact that the two cuts may form a combined single screw hole implies that the total dimension of the two baseplates is smaller than that of conventional baseplates. This is advantageous, especially when many refrigerant tube connectors 63 must be mounted, as in the case where more than one indoor unit 11 are connected with the outdoor unit 1.

Figure 20:
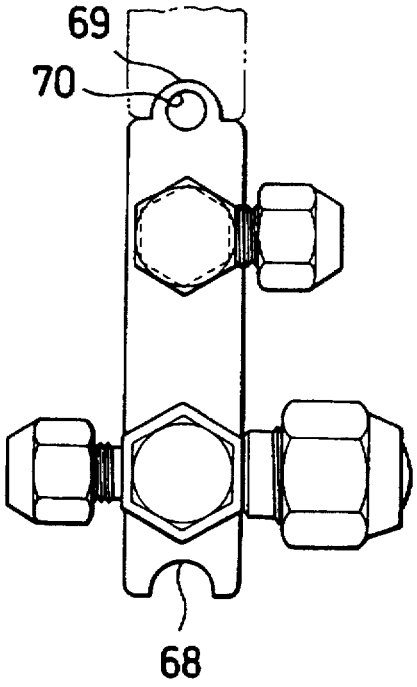
FIG. 20 is plan view illustrating another arrangement of the refrigerant connector according to the invention.

In the foregoing description an emphasis has been laid on the feature of the semi-circular cuts 66 formed on the opposite ends of each baseplate 64. However, the baseplate of the invention is not limited to this configuration. That is, the baseplate of the refrigerant tube connector 63 may have a second configuration as shown in FIG. 20, in which one end of the baseplate has a protruding section 69 having a hole 70 for receiving a screw 9 and a semi-circular cut 26 formed at the opposite end of the baseplate. In assembling two refrigerant tube connectors 63, the protruding section 69 of one baseplate is superposed on the periphery of the semi-circular cut 26 of the other baseplate. Consequently, the two ends, and hence the two baseplates, are firmly secured in position on the mounting site of the outdoor unit 1 with a single screw 9.

It will be apparent that two refrigerant tube connectors 63 of the second type may also be mounted on the outdoor unit 1 with only three screws, and thus has the same advantages as the first refrigerant tube connectors of the invention over conventional refrigerant tube connectors. It would be needless to say that the diameter of the screw 9 is smaller than the diameter of the hole 70.

Figure 21:
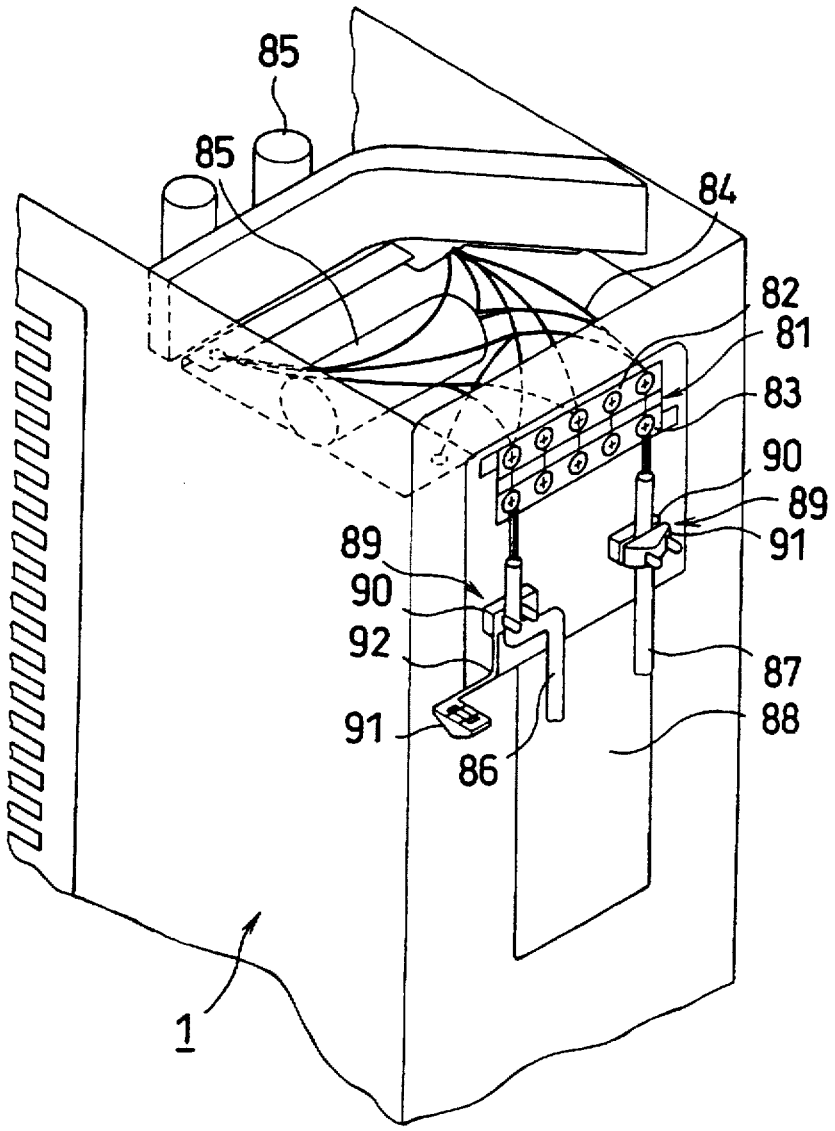
FIG. 21 is a perspective view showing the arrangement of the electric connectors provided on the other side of the outdoor unit, with its cover removed for demonstration of the connectors.
Figure 22:
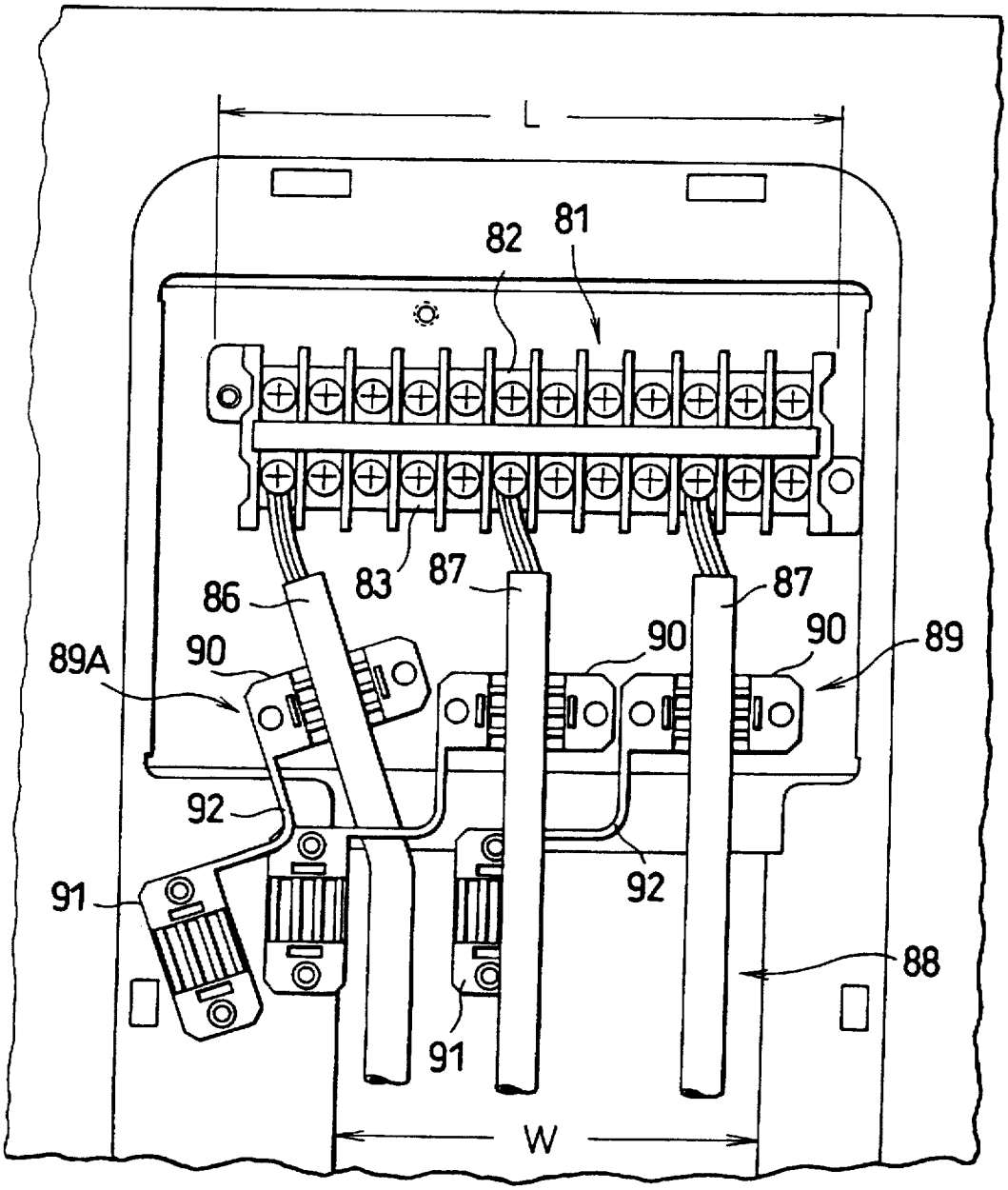
FIG. 22 is a front view of the electric connectors shown in FIG. 21.

We now turn our discussion to the design of the electric connector section 61 located at an upper level of the side wall of the housing of the outdoor unit 1. FIG. 15 shows the electric connector section 61 which is protected by a cover. If the cover is removed, one can see a connector board 81 as shown in FIGS. 21 and 22. Mounted on the upper part of the connector board 81 are a set of electric terminals 82 for electric connection with internal circuits of the outdoor unit 1, and on the lower part of the connector board 81 (below the connectors 82) another set of electric terminals 83 for electric connection with the indoor unit 20.

The electric terminals 82 are connected with various elements of the outdoor unit 1 such as capacitors 85 for a motor of the compressor 8 and a motor of the fan 6*a* for the heat exchanger. The connectors 83 are connected with a cord 86 supplying electric power and cords 87 supplying control signals.

These cords 86 and 87 are accommodated in a recess 88 formed in the side wall of the outdoor unit 1. The recess 88 has a width W which is smaller than the width L of the connector board 81, so that cords 86 and 87 may be compactly held within the recess 88 in parallel with each other.

Mounted between the connector board 81 and the recess 88 are cord fixation devices 89 for fixing in position the cords 86 and 87.

Each of the cord fixation devices 89 has a cord receiving member 90, a cord stabilizing member 91, and a flexible thin strip member 92 connecting the cord receiving member 90 and the cord stabilizing member 91, as shown in detail in FIGS. 23–27. All of these members are made of a plastic. On a cord receiving face of the cord receiving member 90 are a pair of protruding tongues 93 for holding there between a cord such as the cords 86 and 87, and a few ribs 94 for nipping the cords in collaboration with similar ribs 98 formed on the mating surface of the cord stabilizing member 91, as described further below. The cord receiving member 90 also has a pair of mounting pawls 95 and a pair of threaded holes formed near the edges of cord receiving member 90.

Figure 25:
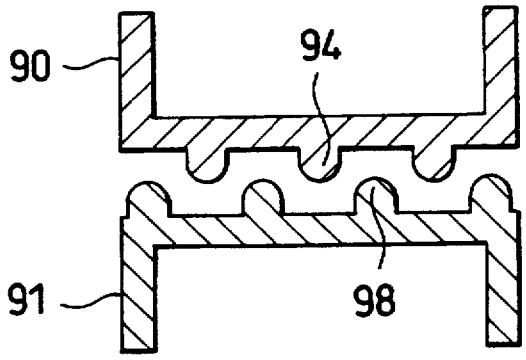
FIG. 25 shows an offset arrangement of the ribs of the cord stabilizing member and the cord receiving member as the both members are coupled with each other.

The cord stabilizing member 91 is formed with a pair of slits 97 for receiving therein the tongues 93, and has the cord fixation ribs 98 on the mating face thereof, as mentioned above. The ribs 98 of the cord stabilizing member 91 and the ribs 98 of the cord receiving member 90 are offset in the transverse direction thereof when the cord stabilizing member 91 is fitted on the cord receiving member 90, as shown in FIG. 25.

The cord stabilizing member 91 is also provided with a pair of holes 99 in correspondence with the holes 96 for receiving therein screws 100. Coaxially formed about each of the holes 99 are short protrusions 99*a* for maintaining a small gap between the two mating surfaces of the members 90 and 91 when the two members are coupled together, so that the cord nipped by the ribs 94 and 98 would be firmly held in position, but without being scarred by the ribs.

It should be understood that the strip member 92 connecting the cord receiving member 90 and the cord stabilizing member 91 has a length sufficient in freely mounting and dismounting the cord stabilizing member 91 on the cord receiving member 90, i.e. in slipping the tongues 93 into the slits 97. The strip 92 has an L-shaped configuration when the cord stabilizing member 91 is not mounted on the cord receiving member 90, as shown in FIGS. 22–24, but it is deflected in the shape of U when the cord stabilizing member 91 is mounted on the cord receiving member 90.

Figure 23:
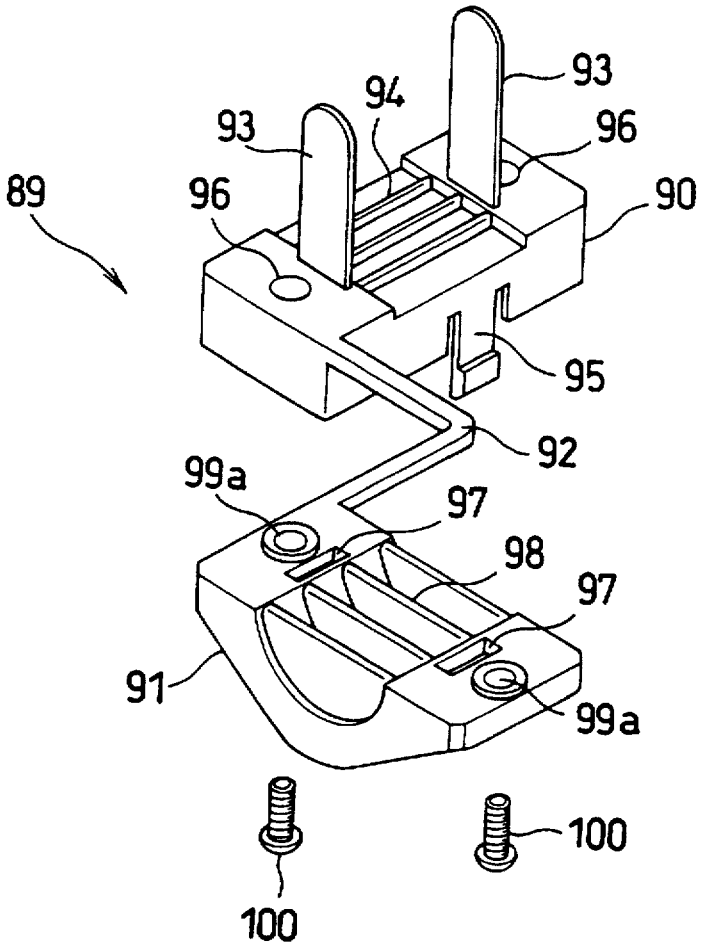
FIG. 23 is a cord fixation device for securing the electric cords connected with the electric connectors shown in FIG. 22, with its cord stabilizing member dismounted from the cord receiving member of the cord fixation device.
Figure 24:
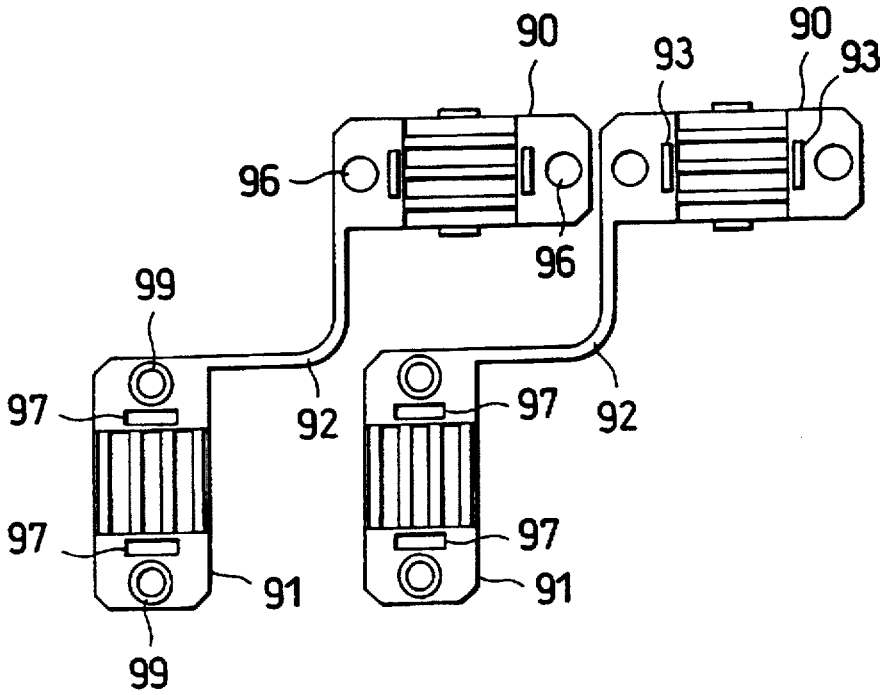
FIG. 24 is a plan view showing an arrangement of multiple cord fixation devices.

Further, the cord fixation device 89 is designed such that, when the mating surfaces of the cord receiving member 90 and the cord stabilizing member 91 are separated from each other, the two members, and hence the strip member 92 also, may assume a common plane and extend in an orthogonal relationship, as shown in FIG. 23.

The resilient mounting pawls 95 of the cord fixation device 89 may be easily inserted in corresponding holes formed in the side wall of the outdoor unit 1, so that the cord fixation device 89 may be temporally mounted on the outdoor unit 1 without screws until the cord fixation device 89 holds a cord between the cord fixation device 89 and the cord receiving member 90. After a cord 86 or 87 is fixed in the cord fixation device 89, the device is firmly secured on the side wall by a pair of screws 100.

It should be noted that the cord stabilizing member 91 is initially offset from the cord receiving member 90 in a diagonal direction by the flexible strip 92, as mentioned above. This is convenient in mounting the cords 86 and 87 in that the cords may be placed on the cord receiving member 90 from above without being bothered by the cord stabilizing member 91, in contrast to conventional cord holders in which a cord must be inserted in the cord fixation device from one side thereof. Also, since the cord receiving member 90 and the cord stabilizing member 91 are connected by a flexible strip 92 and since they may be offset by 90 degrees in the same plane as the device is opened, the cord stabilizing member 91 may be extended in a position where it does not interfere with the cord mounted in the next cord fixation device 89. This is the true even when multiple cord fixation devices are mounted in close proximity to each other, as shown in FIG. 22.

Thus, it is possible to mount a multiplicity of cord fixation devices 89 laterally and closely on the outdoor unit 1, thereby minimizing the space for electric connections and hence minimizing the thickness of the outdoor unit 1. The merit of the cord fixation device 89 of the invention is apparent when it is compared with a conventional one in which a cord stabilizing member 91 is connected to a cord receiving member 90 with a hinge. Such a conventional cord fixation device 89 requires a much larger space, since it must be sufficiently spaced apart from the adjacent one in order to avoid interference with the adjacent cord fixation device 89 when it is opened. Hence, the conventional cord fixation device is not suited for holding many cords on a thin type outdoor unit 1. The cord fixation device 89 of the invention assures easy and safe mounting of many cords on a thin type outdoor unit 1.

Figure 26:
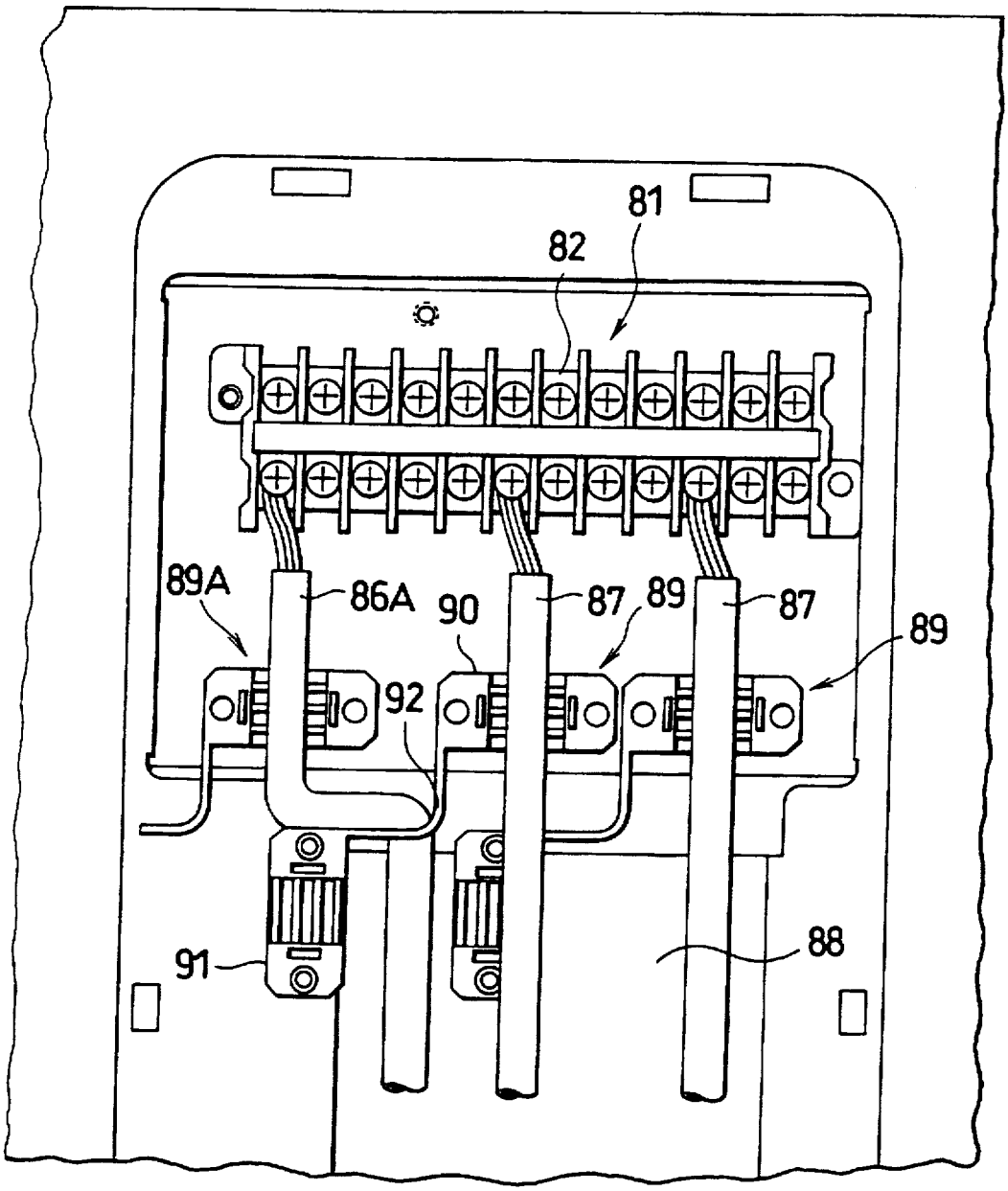
FIG. 26 is a plan view of a connector board, showing a cord twisted twice by 90 degrees when the cord is held in one of lateral cord fixation devices for electrical connection with the connectors.

The fact that the width W of the recess 88 is smaller than the width L of the connector board 81 might seem to cause a difficulty that, when a multiplicity of cord fixation devices 89 are arranged lateral with each other as shown in FIG. 26 in an effort to save spaces between them, one of the cords, for example the power supply cord 86A, must be bent twice by 90 degrees if the cord must pass through the far left cord fixation device 89A.

However it is not easy to bend a power cord like this, since a thick power cord usually has greater rigidity than other cords. This is in conflict with the fact that it is preferable to set a power cord away from other cords 87 which contain control lines, i.e. in the far left cord fixation device 89A.

In order to solve this conflict the far left cord fixation device 89A may be mounted at an oblique position with respect to the next device, as shown in FIG. 22. This allows the cord 86A to be oriented in a more natural direction by slightly bending the cord. Thus, even a thick power cord may be connected quite easily to a terminal 29*b* of the connector board 81.

As described above, a multiplicity of parallel cords may be easily mounted on a compact connector board 81 whose recess 88 has a width L lager than the width W, by simply orienting some of the cord fixation devices 89 only slightly.

The various cords 86 and 87 inserted in the cord fixation devices 89 are firmly secured in position between the cord receiving members 90 and cord stabilizing members 91 with the ribs 94 and 98 of the respective devices 89.

It would be appreciated that the ribs 94 and 98 of a cord receiving member 90 and a cord stabilizing member 91, respectively, have a little space between them, so that the electric lines in the cord 86 or 87 will not be damaged in the cord fixation device 89 even when the cord stabilizing member 91 is coupled with the cord receiving member 90 to hold the cord 86 or 87.

In as much as the present invention is subject to many variations, modifications and changes in detail, it is intended that the subject matter discussed above and shown in the accompanying drawings may be interpreted as illustrative not in a limiting sense.

What we claim is:

1. A separate type air conditioner which includes an outdoor unit and an indoor unit having at least a compressor, a heat exchanger having a peripheral frame with a bore for a screw, and an expansion device, said outdoor and indoor units being connected with each other by refrigerant tubes so that they altogether form a refrigeration cycle of said air conditioner, said outdoor unit comprising:

a baseplate;

a housing containing a side wall having a side air intake window, a rear wall having a rear air intake window, and a front wall having an air outlet window, said walls being extended upright from said baseplate; and a partition board having a peripheral franc and extending upright from said baseplate for separating the internal space of said housing into a fan compartment for accommodating said heat exchanger and a fan for supplying air to said heat exchanger, and a machinery compartment for accommodating said compressor, said peripheral frame of said partition board having a bore fitted to said bore of said heat exchanger when said heat exchanger is extended over said rear air intake window in said rear wall and said partition board is mounted upright on said baseplate, wherein said heat exchanger is configured in the form of an L in the top view thereof, and has one section extending over said side air intake window in said side wall, another section connected to said one section by a connecting section extending over said rear air intake window in said rear wall when said heat exchanger is mounted upright on said baseplate;

said partition board is disposed in front of said heat exchanger when said peripheral frame of said partition board is mounted on the front end of said peripheral frame of said heat exchanger by at least one screw applied from the rear of said heat exchanger;

said side air inlet window has front and rear vertical columns of horizontal slits and an intermediate strip separating said two columns, said front column of slits facing said one heat exchanger section and said intermediate strip facing said connecting section of said heat exchanger;

said housing is provided on the ceiling thereof with front and rear plateau regions extending across said ceiling and having widths that match corresponding columns of slits in said side air intake window, said plateau regions defining an intermediate groove therebetween which has the same width as, and is aligned to communicate with, said intermediate strip of said side air intake window.

2. An outdoor unit according to claim 1, wherein the width of said front column of said slits in said side air intake window is greater than the width of the rear column and corresponds substantially with the length of said one heat exchanger section;

the widths of said front and rear plateau regions are substantially the same as the corresponding widths of said columns, respectively.

3. A separate type air conditioner which includes an outdoor unit and an indoor unit having a compressor, a heat exchanger and an expansion device, said outdoor and indoor units being connected with each other by refrigerant tubes so that they altogether form a refrigeration cycle of said air conditioner, said outdoor unit comprising:

a baseplate;

a housing containing a side wall having a first air intake window, a rear wall having a second air intake window, and a front wall having an air outlet window, said walls extending upright from said baseplate;

means forming a partition separating the internal space of said housing into a fan compartment for accommodating said heat exchanger and a fan for supplying air to said heat exchanger, and a machinery compartment for accommodating said compressor, wherein said heat exchanger is configured in the form of a L in the top view thereof, and has one section facing said first air inlet window and another section facing said second air inlet window, said sections of said heat exchanger being substantially mutually perpendicular and containing a connecting section therebetween;

said side air inlet window having front and rear vertical columns of horizontal slits and an intermediate strip separating said columns, said front column of slits facing said one heat exchanger section and said intermediate strip facing said connecting section;

said housing being provided on the ceiling thereof with front and rear plateau regions extending across said ceiling and having widths that substantially match corresponding columns of slits in said side air intake window, said plateau regions defining an intermediate groove therebetween which has substantially the same width as, and is aligned to communicate with, said intermediate strip of said side air intake window.

4. An outdoor unit according, to claim 3, wherein the width of said front column of said slits in the side air intake window is greater than the width of the rear column and corresponds substantially with the length of said one heat exchanger section; and the widths of said front and rear plateau regions are substantially the same as the corresponding widths of said columns, respectively.

* * * * *